US011946685B2

(12) United States Patent
You et al.

(10) Patent No.: US 11,946,685 B2
(45) Date of Patent: Apr. 2, 2024

(54) REFRIGERATOR

(71) Applicant: Samsung Electronics Co., Ltd., Suwon-si (KR)

(72) Inventors: Youngmin You, Suwon-si (KR); Ilsung Bae, Suwon-si (KR); Jinyoung Song, Suwon-si (KR); Byungkwan Yang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 171 days.

(21) Appl. No.: 17/341,965

(22) Filed: Jun. 8, 2021

(65) Prior Publication Data

US 2021/0396449 A1 Dec. 23, 2021

(30) Foreign Application Priority Data

Jun. 17, 2020 (KR) ..... 10-2020-0073937

(51) Int. Cl.

| | |
|---|---|
| ***F25D 17/04*** | (2006.01) |
| ***F25D 17/06*** | (2006.01) |
| ***F25D 17/08*** | (2006.01) |
| ***F25D 23/02*** | (2006.01) |
| ***F25D 25/02*** | (2006.01) |

(52) U.S. Cl.

CPC ..... *F25D 17/045* (2013.01); *F25D 17/065* (2013.01); *F25D 17/08* (2013.01); *F25D 23/021* (2013.01); *F25D 25/02* (2013.01); *F25D 2317/063* (2013.01); *F25D 2317/0665* (2013.01)

(58) Field of Classification Search

CPC ..... F25D 17/045; F25D 17/065; F25D 17/08; F25D 23/021; F25D 25/02; F25D 2317/063; F25D 2317/0665

See application file for complete search history.

(56) References Cited

U.S. PATENT DOCUMENTS

| | | | | |
|---|---|---|---|---|
| 4,831,837 | A * | 5/1989 | Negishi | F25D 19/04 62/332 |
| 5,632,543 | A * | 5/1997 | McGrath | F25D 23/063 220/592.27 |
| 2011/0296864 | A1* | 12/2011 | Kim | F25C 5/182 62/344 |
| 2018/0172336 | A1* | 6/2018 | Bae | F25D 17/062 |

FOREIGN PATENT DOCUMENTS

| | | |
|---|---|---|
| CN | 107940870 B | 11/2020 |
| JP | 53-84754 | 7/1978 |
| JP | 6-229659 | 8/1994 |

(Continued)

OTHER PUBLICATIONS

KR-102463792-B1 translation.*

(Continued)

*Primary Examiner* — Elizabeth J Martin

(74) *Attorney, Agent, or Firm* — STAAS & HALSEY LLP

(57) ABSTRACT

A refrigerator includes an outer case, an inner case coupled to the outer case and equipped with a storeroom, a heat exchanger disposed adjacent to the storeroom to supply cold air, and a front cover defining one side of the storeroom. The front cover includes at least one end having a recessed portion that forms a cold air supply port to supply cold air supplied from the heat exchanger into the storeroom.

20 Claims, 21 Drawing Sheets

(56) References Cited

FOREIGN PATENT DOCUMENTS

| | | | | |
|---|---|---|---|---|
| JP | 11-325694 | | | 11/1999 |
| JP | 2000-65459 | | | 3/2000 |
| JP | 2002-62018 | | | 2/2002 |
| JP | 2002062018 | A | * | 2/2002 |
| JP | 2019-117036 | A | | 7/2019 |
| KR | 20-1996-0005800 | U | | 2/1996 |
| KR | 20-0293347 | | | 2/2003 |
| KR | 2003-0094028 | | | 12/2003 |
| KR | 20-0345580 | | | 3/2004 |
| KR | 10-0432713 | | | 5/2004 |
| KR | 10-0446777 | | | 9/2004 |
| KR | 10-2012-0039913 | A | | 4/2012 |
| KR | 10-1184551 | | | 9/2012 |
| KR | 10-2015-0072951 | A | | 6/2015 |
| KR | 10-1637690 | | | 7/2016 |
| KR | 10-2017-0092335 | A | | 8/2017 |
| KR | 10-2018-0039871 | A | | 4/2018 |
| KR | 102463792 | B1 | * | 4/2018 |
| KR | 10-2019-0127027 | A | | 11/2019 |

OTHER PUBLICATIONS

JP-2002062018-A translation.*
International Search Report for PCT Application No. PCT/KR2021/006845 dated Sep. 29, 2021 (3 pages).
European Search Report dated May 23, 2023 issued in European Application No. EP 21 82 5613.

* cited by examiner

REFRIGERATOR

CROSS-REFERENCE TO RELATED APPLICATION

This application is based on and claims the benefit of priority under 35 U. S. C. § 119 to Korean Patent Application No. 10-2020-0073937 filed on Jun. 17, 2020, in the Korean Intellectual Property Office, the disclosure of which is incorporated herein by reference in its entirety.

BACKGROUND

1. Field

The disclosure relates to a refrigerator, and more particularly, to a refrigerator capable of cooling a storeroom evenly.

2. Discussion of Related Art

Refrigerators are devices having storerooms for storing groceries and a cold air supply for supplying cold air into the storerooms to keep the groceries fresh. The storerooms include a fridge maintained at temperatures of about 0 to 5 degrees Celsius for keeping groceries cool, and a freezer maintained at temperatures of about 0 to −30 degrees Celsius for keeping groceries frozen.

The refrigerators may be classified by the position of fridge and freezer and the type of door. Specifically, the refrigerator may be classified into a bottom mounted freezer (BMF) type in which the fridge is positioned on the upper side and the freezer is positioned on the lower side, a top mounted freezer (TMF) type in which the fridge is positioned on the lower side and the freezer is positioned on the upper side, and a side-by-side type in which the freezer is positioned on the left side and the fridge is positioned on the right side. Furthermore, the BMF type refrigerator includes a French door refrigerator equipped with a pair of fridge doors to open or close the fridge, and a four-door type refrigerator equipped with a pair of fridge doors to open or close the fridge and a pair of freezer doors to open or close the freezer.

The refrigerator may include a cold air supply port through which to supply cold air to keep the groceries fresh.

SUMMARY

The disclosure provides a refrigerator having an enhanced design.

The disclosure also provides a refrigerator having an enhanced design such that a storeroom has a uniform temperature distribution.

The disclosure also provides a refrigerator having reduced production costs.

According to an aspect of the disclosure, a refrigerator includes an outer case, an inner case equipped with a storeroom, a heat exchanger arranged to be adjacent to the storeroom to supply cold air into the storeroom, and a front cover defining one side of the storeroom and including a cold air supply port formed by being cut inwards from an outer circumference of the front cover to supply cold air produced from the heat exchanger to the storeroom.

The refrigerator may further include a cold air guide arranged to guide the cold air supplied through the cold air supply port into the storeroom.

The cold air supply port may be recessed from a top end of the front cover and arranged to be adjacent to a top wall defining the storeroom.

The cold air guide may be arranged on the top wall defining the storeroom.

The refrigerator may further include a top guide arranged on the top wall defining the storeroom to form a top fluid path for guiding cold air to the cold air guide.

The refrigerator may further include a middle cover arranged behind the front cover and including a middle guide wall connected to the top guide and the cold air supply port for guiding the cold air to the top guide and the cold air supply port, a rear cover coupled to the middle cover from behind the middle guide wall to form a rear fluid path for guiding cold air to the top guide and the cold air supply port, and a circulation fan arranged below the middle cover to circulate the cold air into the rear fluid path.

The front cover may be provided to supply cold air into the storeroom only through the cold air supply port.

The cold air supply port may be formed by being cut inwards from both side ends of the front cover.

The refrigerator may further include a door arranged to open or close the storeroom, and a discharge port arranged on the top wall defining the storeroom to discharge cold air into the storeroom, and the cold air guide may further include a blade provided to open or close the discharge port and the blade may control an opening or closing degree of the discharge port depending on an opening or closing of the door.

The middle cover may include a communication hole connected to the top guide to supply cold air to the cold air guide, and the top guide may further include a damper arranged to be adjacent to the communication hole to control a rate of flow of the cold air flowing to the cold air guide.

The refrigerator may further include a shelf arranged in the storeroom and including a shelf fluid path for guiding cold air produced from the heat exchanger and a cold air supply hole formed in at least one of an upper portion or a lower portion to supply the cold air into the storeroom.

The front cover may include a first cover part and a second cover part detachably arranged on a bottom of the first cover part, and the first cover part may include a first cold air supply port formed by being cut on an outer circumference of the first cover part.

The second cover part may include a second cold air supply port formed by being cut from an outer circumference of the second cover part.

The first cold air supply port may be recessed upwards from a bottom end of the first cover part, and the second cold air supply port may be recessed downwards from a top end of the second cover part.

The refrigerator may further include a shelf arranged in front of the first and second cold air supply ports in the storeroom.

The refrigerator may further include a shelf arranged in the storeroom, and at least one door guard opening or closing the storeroom and separately arranged in the vertical direction on the rear surface of the door, and the at least one door guard may include a bottom hole arranged on the bottom of the at least one door guard to circulate cold air discharged from the cold air guide in the storeroom to discharge the cold air to another door guard, and a backward hole for supplying cold air to the shelf.

The refrigerator may further include a door guard arranged on the rear surface of the door for opening or closing the storeroom, and the door guard may include a cold air direction guide formed as a curved plane to guide the cold air discharged from the cold air guide into the storeroom.

According to another aspect of the disclosure, a refrigerator may include an outer case including an inner case, a storeroom arranged in the inner case, a heat exchanger arranged to supply cold air into the storeroom, and a front cover defining one side of the storeroom and including a cold air supply port cut inwards from an end of the front cover to supply cold air to the storeroom.

The cold air supply port may be formed by being cut inwards from a top end of the front cover.

According to another aspect of the disclosure, a refrigerator may include an outer case including an inner case, a storeroom formed in the inner case, a heat exchanger arranged behind the storeroom to produce cold air, and a front cover formed with glass and including a cold air supply port arranged on the back of the storeroom to supply cold air into the storeroom, wherein the cold air supply port may be formed as a recessed portion cut from a top end of the front cover to have a recess.

The refrigerator may further include a cold air guide arranged on a top wall defining the storeroom to circulate the cold air supplied through the cold air supply port in the storeroom.

BRIEF DESCRIPTION OF THE DRAWINGS

The above and other aspects, features and advantages of the disclosure will become more apparent from the following description of example embodiments with reference to the accompanying drawings, in which.

DETAILED DESCRIPTION

Figure 1:
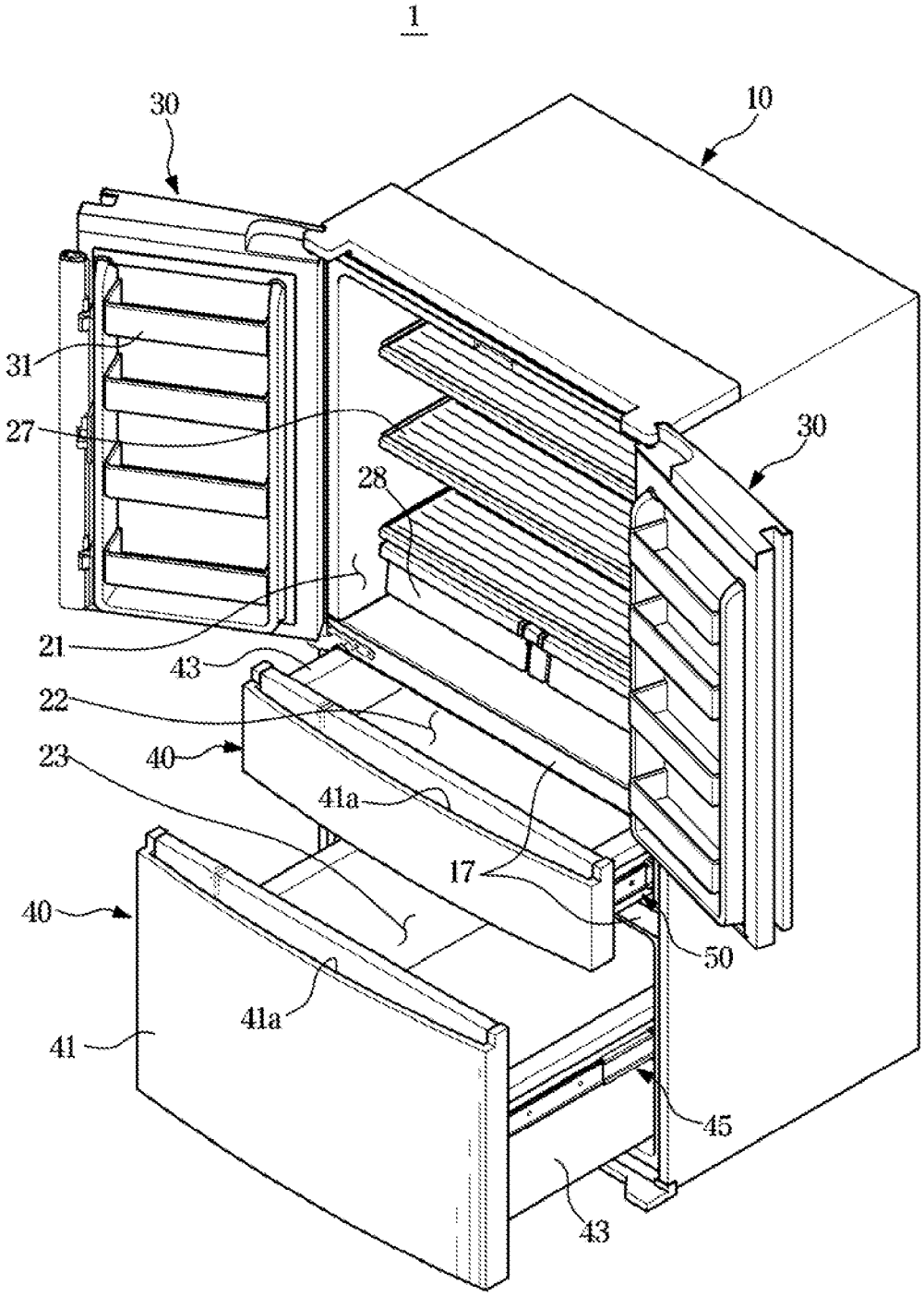
FIG. 1 shows a refrigerator, according to an embodiment of the disclosure.

Embodiments and features as described and illustrated in the disclosure are merely examples, and there may be various modifications replacing the embodiments and drawings at the time of filing this application.

Throughout the drawings, like reference numerals refer to like parts or components.

The terminology used herein is for the purpose of describing example embodiments only and is not intended to limit the disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or room discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "forward (or front)", "rearward (or rear)", "upward (or upper)", "left", and "right" as herein used are defined with respect to the drawings, but the terms may not restrict the shape and position of the respective components.

For example, as shown in FIG. 1, a direction in which a door 40 is pulled open is defined as a forward direction, with respect to which, rearward, left, right, up and down are defined.

Reference will now be made in detail to embodiments of the disclosure, which are illustrated in the accompanying drawings, wherein like reference numerals refer to the like elements throughout.

Figure 2:
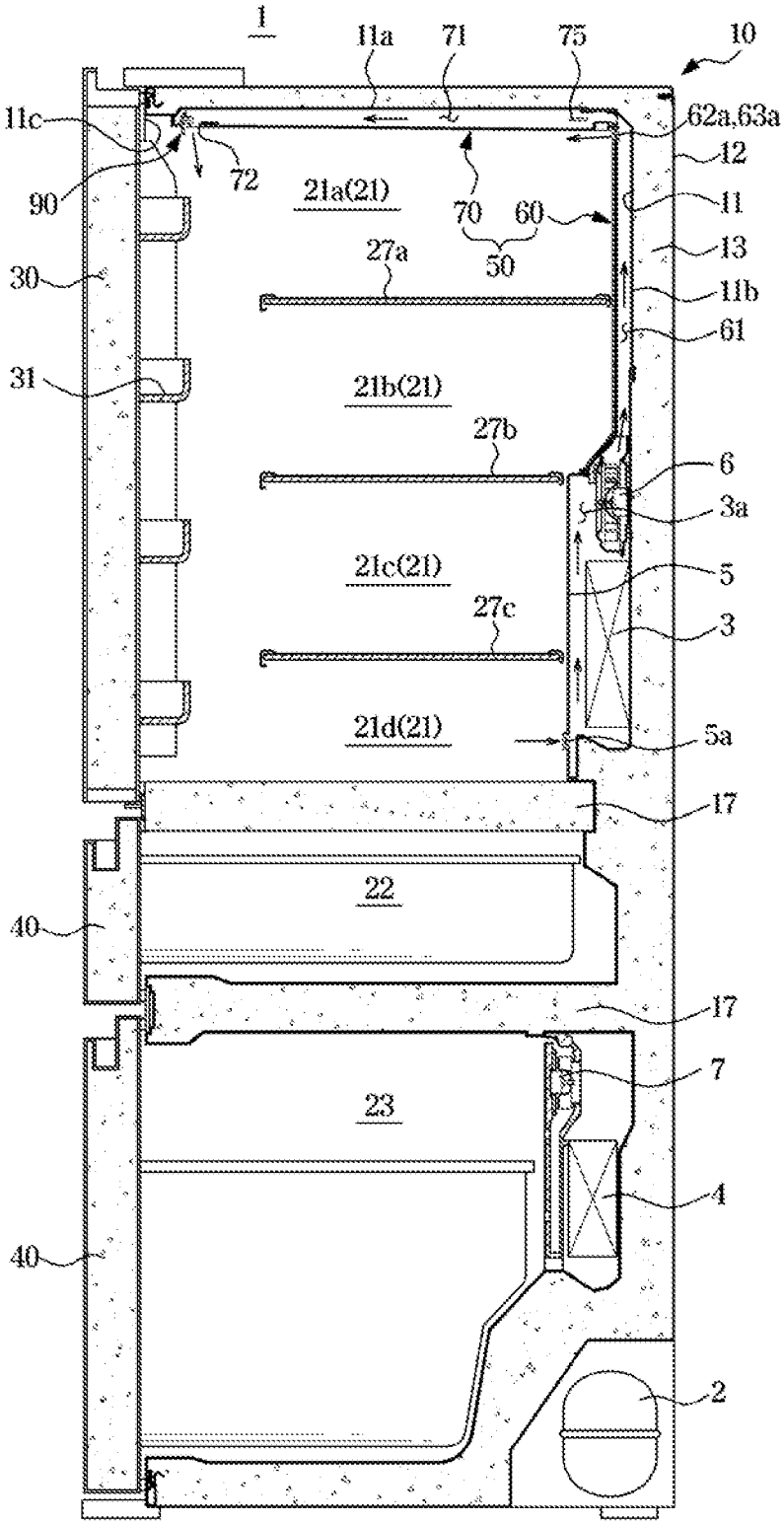
FIG. 2 is a schematic side cross-sectional view of the refrigerator of FIG. 1.

FIG. 1 shows a refrigerator, according to an embodiment of the disclosure. FIG. 2 is a schematic side cross-sectional view of the refrigerator of FIG. 1.

Referring to FIGS. 1 and 2, a refrigerator 1 may include a main body 10 having storerooms 21, 22, and 23, doors 30 and 40 arranged to open or close the storerooms 21, 22, and 23, and a cold air supply device (not shown) for supplying cold air to the storerooms 21, 22, and 23.

The main body 10 may include an inner case 11 that defines the storerooms 21, 22, and 23, an outer case 12 coupled onto the outer side of the inner case 11, and insulation 13 arranged between the inner case 11 and the outer case 12. The inner case 11 may be formed of a plastic substance through injection molding, and the outer case 12 may be formed of a metal substance. The outer case 12 may also be referred to as a cabinet 12. For the insulation 13, a urethane foam insulation may be used, and a vacuum insulation panel may also be used along with the urethane foam insulation as required. The main body 10 may include middle walls 17 that vertically divide the storerooms 21, 22, and 23. The storerooms 21, 22, and 23 may be divided into first, second, and third storerooms 21, 22, and 23. The inner case 11 may further include a top side 11*a*, a rear side 11*b*, both sides (i.e., left and right sides), and a front side 11*c*.

The storerooms 21, 22, and 23 may be used as a fridge maintained at temperatures of about 0 to 5 degrees Celsius for keeping groceries cool, and a freezer maintained at temperatures of about minus 30 to 0 degrees Celsius for keeping groceries frozen.

The storerooms 21, 22, and 23 are formed to have an open front through which to take out or put in groceries, and the open front may be opened or closed by the doors 30 and 40. The storerooms 21, 22, and 23 may have shelves 27 to put groceries thereon.

There may be a plurality of shelves 27. The shelves 27 may include a first shelf 27*a* arranged uppermost in the storeroom 21, a second shelf 27*b* arranged under the first shelf 27*a*, and a third shelf 27*c* arranged under the second shelf 27*b*. In other words, the second shelf 27*b* may be arranged between the first shelf 27*a* and the third shelf 27*c*. However, the number of the shelves is not limited to three, and there may be four or more or two or less of the shelves.

The first storeroom 21 may be partitioned into a plurality of spaces. The plurality of spaces may include a first space 21*a*, a second space 21*b*, a third space 21*c*, and a fourth space 21*d*. The first space 21*a* may be formed between a top wall that makes up the storeroom 21 and the first shelf 27*a*. The second space 21*b* may be arranged under the first space 21*a* and between the first shelf 27*a* and the second shelf 27*b*. The third space 21*c* may be arranged under the second space 21*b* and formed between the second shelf 27*b* and the third shelf 27*c*. In other words, the second space 21*b* may be arranged between the first space 21*a* and the third space 21*c*. The fourth space 21*d* may be arranged underneath the third shelf 27*c*. In other words, it may be the lowest of the plurality of spaces. A drawer 28 may be provided in the storeroom 21, for example below shelf 27*c*, as shown in FIG. 1.

The door 30 may be coupled to the main body 10 to be rotated to the left or right. Door guards 31 may be provided on the rear surface of the door 30 to store groceries.

The door 40 may be provided to slide into or out of the storeroom 22 or 23, and may include a door part 41 covering the open front of the storeroom 22 or 23 and a basket 43 coupled to the rear surface of the door part 41. The basket 43 may be supported by a rail 45 to slide. A handle 41*a* may be formed on the door part 41.

The cold air supply device may generate cold air by using latent heat of a refrigerant through a cooling cycle. The cold air supply device may include a compressor 2, a condenser, an expansion device, evaporators 3 and 4, and blower fans 6 and 7. The evaporators 3 and 4 may also be referred to as heat exchangers 3 and 4.

The evaporator 3 may be arranged behind the storeroom 21 to produce cold air. The evaporator 3 may be accommodated in a cooling room 3*a* formed by an evaporator cover 5. A suction port 5*a* may be formed at the evaporator cover 5 and air may be sucked from the storeroom 21 into the cooling room 3*a* through the suction port 5*a*.

The blower fan 6 may be provided in the cooling room 3*a* to circulate air. The cooling room 3*a* may be connected to a cold air guide assembly 50 for guiding cold air of the cooling room 3*a*. With this structure, when the blower fan 6 is operating, the air is sucked into the cooling room 3*a* from the storeroom 21 through the suction port 5*a*, and the air sucked in may be cooled down by the evaporator 3 and then guided to the cold air guide assembly 50.

The cold air guide assembly 50 may include a rear guide 60 arranged behind the storeroom 21 and a top guide 70 arranged on top of the storeroom 21.

The rear guide 60 may include a rear fluid path 61 for guiding the cold air produced from the evaporator 3, and a cold air supply port 62*a* and 63*a* for supplying the cold air into the storeroom 21 from the rear fluid path 61 to cool down the storeroom 21. The cold air supply port 62*a* and 63*a* may supply the cold air into the first space 21*a*. The air sucked in through the suction port 5*a* may pass through the evaporator 3 and the blower fan 6 and may then be supplied into the storeroom 21 through the cold air supply port 62*a* and 63*a*. The rear guide 60 may serve as a cold air supply device 60.

In FIG. 2, it is shown that the suction port 5*a* is arranged on the bottom while the cold air supply port 62*a* and 63*a* is provided on the top, so that the air flows from bottom to top in the storeroom 21. That is, it is shown that air is sucked from the fourth space 21*d* and supplied to the first space 21*a*. It is not, however, limited thereto, and the air may be sucked from the first space 21*a* and supplied to the fourth space 21*d*.

The top guide 70 may include a top fluid path 71 connected to the rear fluid path 61, a discharge port 72 for forming an air curtain across the open front of the storeroom 21 or for discharging cold air into the storeroom 21 from the top fluid path 71, and a damper 75 for controlling an amount of cold air supplied to the discharge port 72.

A cold air guide 90 may be arranged across the discharge port 72 to control an opening or closing of the discharge port 72. The cold air guide 90 may be arranged to be adjacent to the top wall of the inner case 11. In other words, the cold air guide 90 may be arranged on one wall of the storeroom 21. The cold air guide 90 and the discharge port 72 may be arranged to be adjacent to the door 30. Specifically, the cold air guide 90 and the discharge port 72 may be arranged to be adjacent to the open front. The cold air guide 90 and the discharge port 72 are not, however, limited to these positions, but may be arranged in many different positions.

With this structure, when the blower fan 6 is operating and the cold air guide 90, arranged to be adjacent to the top wall of the inner case 11, opens the discharge port 72, the cold air produced from the evaporator 3 may sequentially pass through the rear fluid path 61 and the top fluid path 71 and may be discharged down into the storeroom 21 through the discharge port 72, and may cause a direction of the cold air discharged through the cold air supply port 62*a* and 63*a* of the storeroom 21 to be changed.

For example, the cold air discharged through the cold air supply port 62*a* and 63*a* may flow to an area adjacent to the door 30 or the open front, and the cold air may be discharged through the discharge port 72 arranged on the top wall of the inner case 11 adjacent to the door 30. As the cold air is discharged down through the discharge port 72, it may be discharged toward the cold air supplied through the cold air supply port 62*a* and 63*a*, directing the cold air that has reached the area adjacent to the door 30 downwards.

In this case, an angle at which and a direction in which the cold air is discharged down through the discharge port 72 may be controlled by rotating a blade 92 (see FIG. 7) of the cold air guide 90. A direction toward which the cold air supplied through the cold air supply port 62*a* and 63*a* flows may be changed depending on the discharging angle and direction of the cold air from the discharge port 72.

Accordingly, the discharge port 72 and the cold air guide 90 may send the cold air supplied through the cold air supply port 62*a* and 63*a* to the second space 21*b*, third space 21*c*, and fourth space 21*d*. With this structure, groceries in the second space 21*b*, third space 21*c*, and fourth space 21*d* may be kept fresh. Furthermore, when the cold air guide 90 is used, temperature differences between the first, second, third, and fourth spaces 21*a*, 21*b*, 21*c*, and 21*d* may be reduced.

When the blower fan 6 is operating and the cold air guide 90 blocks the discharge port 72, the cold air produced from the evaporator 3 may be discharged into the storeroom 21 through the cold air supply port 62*a* and 63*a* to cool down the storeroom 21.

The top guide 70 may be equipped with the damper 75 for regulating an amount of the cold air supplied to the discharge port 72. The damper 75 may be able to regulate an amount of the cold air supplied to the discharge port 72, so when much of the cold air needs to be supplied into a lower one of the plurality of spaces 21*a*, 21*b*, 21*c* and 21*d* in the storeroom 21, the damper 75 may be opened altogether.

Figure 3:
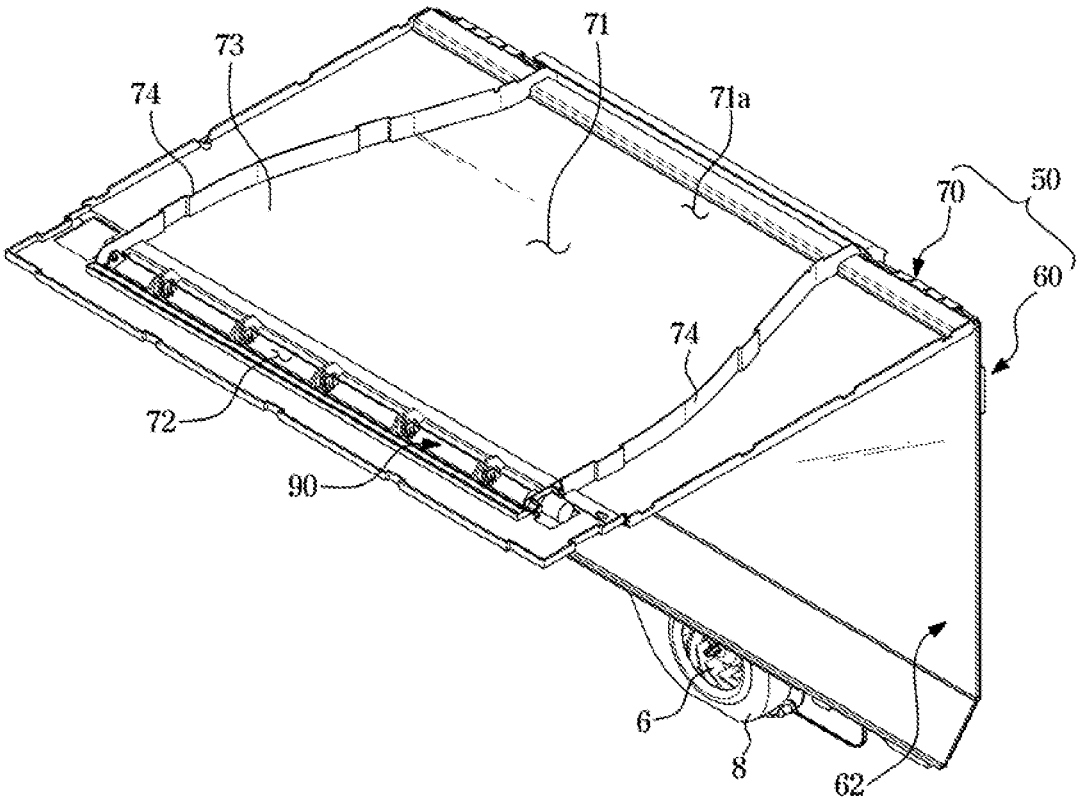
FIG. 3 is a perspective view illustrating a guide of the refrigerator of FIG. 1.
Figure 4:
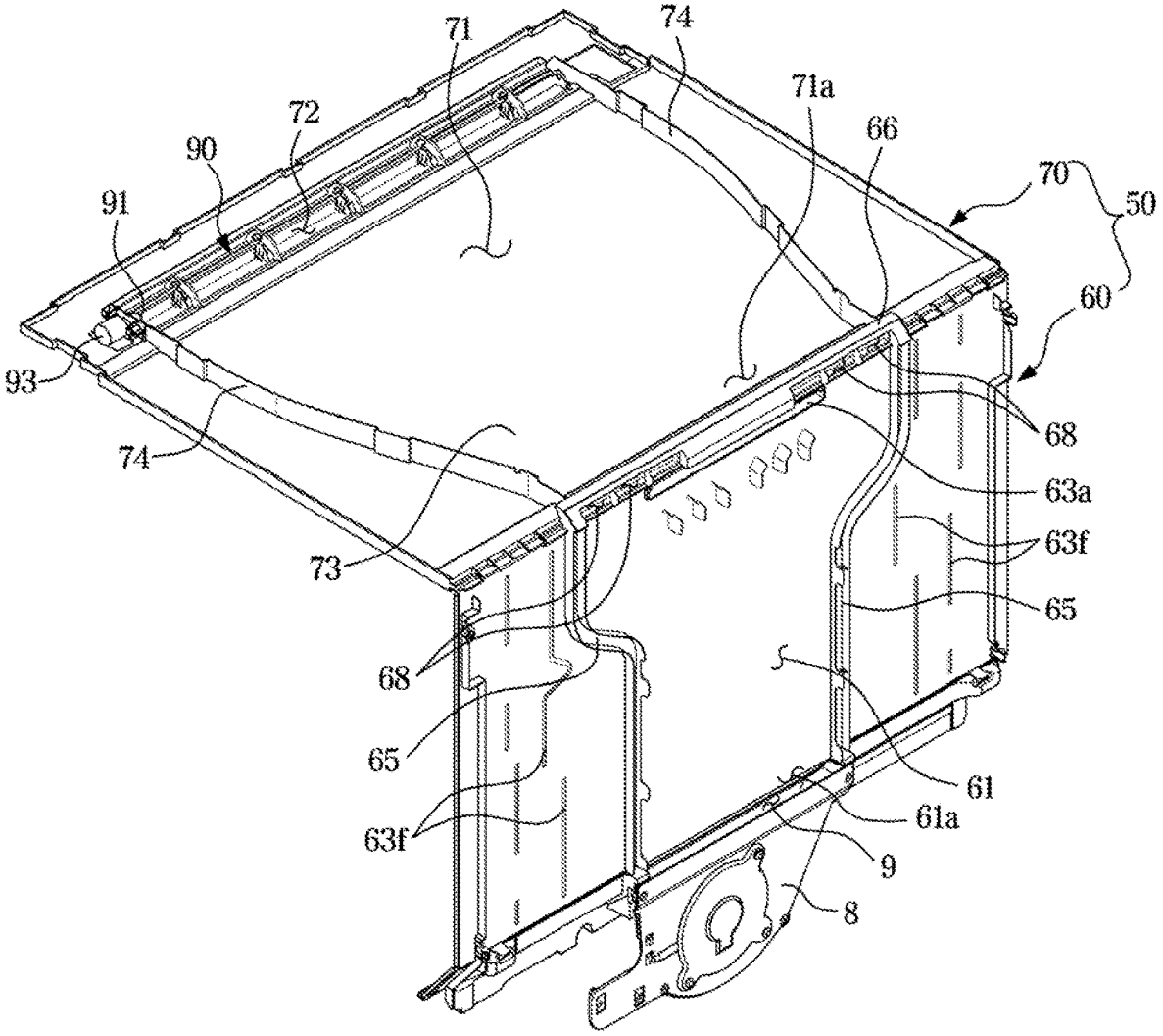
FIG. 4 is a perspective view illustrating the rear side of the guide of the refrigerator of FIG. 1.

FIG. 3 is a perspective view illustrating a guide of the refrigerator of FIG. 1. FIG. 4 is a perspective view illustrating the rear side of the guide of the refrigerator of FIG. 1. The damper 75 is omitted in FIGS. 3 and 4.

Referring to FIGS. 3 and 4, the cold air guide assembly 50 may include a rear guide 60 arranged behind the storeroom 21 and a top guide 70 arranged on top of the storeroom 21. The rear guide 60 and the top guide 70 may be integrally formed, but in the embodiment of the disclosure, the rear guide 60 and the top guide 70 may be separately provided and assembled together to form the cold air guide assembly 50.

For this, the rear guide 60 and the top guide 70 may each include a coupling portion (not shown). The coupling portions may be coupled together through various fitting structures and various coupling structures including a structure coupled with a separate fastening member such as a pin, a screw, a bolt, a rivet, or the like. Further, the rear guide 60 and the top guide 70 may be provided to be detachable from each other.

As such, the rear guide 60 and the top guide 70 may be provided to be attachable to and detachable from each other instead of being integrally formed.

The rear guide 60 may include the rear fluid path 61 for guiding the cold air produced from the evaporator 3, and the cold air supply port 62*a* and 63*a* for discharging the cold air into the storeroom 21 from the rear fluid path 61 to cool down the storeroom 21. Cold air discharged through a discharge port 9 of a blower fan case 8 may flow into an inlet 61*a* of the rear fluid path 61.

The rear guide 60 may include a front cover 62 facing the storeroom 21, a middle cover 63 coupled onto the rear surface of the front cover 62, a pair of middle guide walls 65 arranged to protrude from the middle cover 63 and face each other to form the rear fluid path 61, and a rear cover 64 arranged behind the middle cover 63 and coupled to correspond to the middle guide walls 65 to form the rear fluid path 61.

The rear guide 60 may be coupled to the rear surface of the storeroom 21, and the rear fluid path 61 may be surrounded by the middle cover 63, the middle guide walls 65, and the rear cover 64.

The top guide 70 may include the top fluid path 71 connected to the rear fluid path 61, and the discharge port 72 through which to discharge the cold air down into the storeroom 21 from the top fluid path 71 to supply the cold air to the second, third, and fourth spaces 21*b*, 21*c* and 21*d* of the storeroom 21.

The top guide 70 may include a cover top 73 that separates the storeroom 21 from the top fluid path 71, and a pair of top guide walls 74 arranged to protrude from the cover top 73 and face each other to form the top fluid path 71. The top guide walls 74 may guide the cold air to the cold guide 90, which will be described later. The top fluid path 71 may guide the cold air to the cold air guide 90.

The top guide 70 may be coupled onto the top side 11*a* of the inner case 11, and the top fluid path 71 may be formed by the cover top 73, the pair of top guide walls 74, and the inner case 11. Alternatively, there may be an extra cover member (not shown) arranged between the top guide 70 and the inner case 11, in which case the top fluid path 71 may be surrounded by the top guide 70, the pair of top guide walls 74, and the cover member.

The top guide 70 may cause the cold air produced from the evaporator 3 to flow to the cold air guide 90. Specifically, the cold air may flow to the cold air guide 90 and the discharge port 72 through the top fluid path 71 of the top guide 70.

As described above, the cold air discharged through the cold air supply port 62*a* and 63*a* may flow to an area adjacent to the door 30 or the open front, and the cold air may be discharged through the discharge port 72 arranged on the top wall of the inner case 11 adjacent to the door 30. As the cold air is discharged down through the discharge port 72, it may be discharged toward the cold air supplied through the cold air supply port 62*a* and 63*a*, directing the cold air that has reached the area adjacent to the door 30 downwards.

Accordingly, the direction of the cold air discharged through the cold air supply port 62*a* and 63*a* may be controlled so that the cold air flows to the second space 21*b*, third space 21*c*, and fourth space 21*d*.

The blower fan 6 may be arranged on the bottom between the front cover 62 and the rear cover 64. This may enable the cold air flowing between the middle guide walls 65 formed on the middle cover 63 to be sent to the top guide 70.

Figure 5:
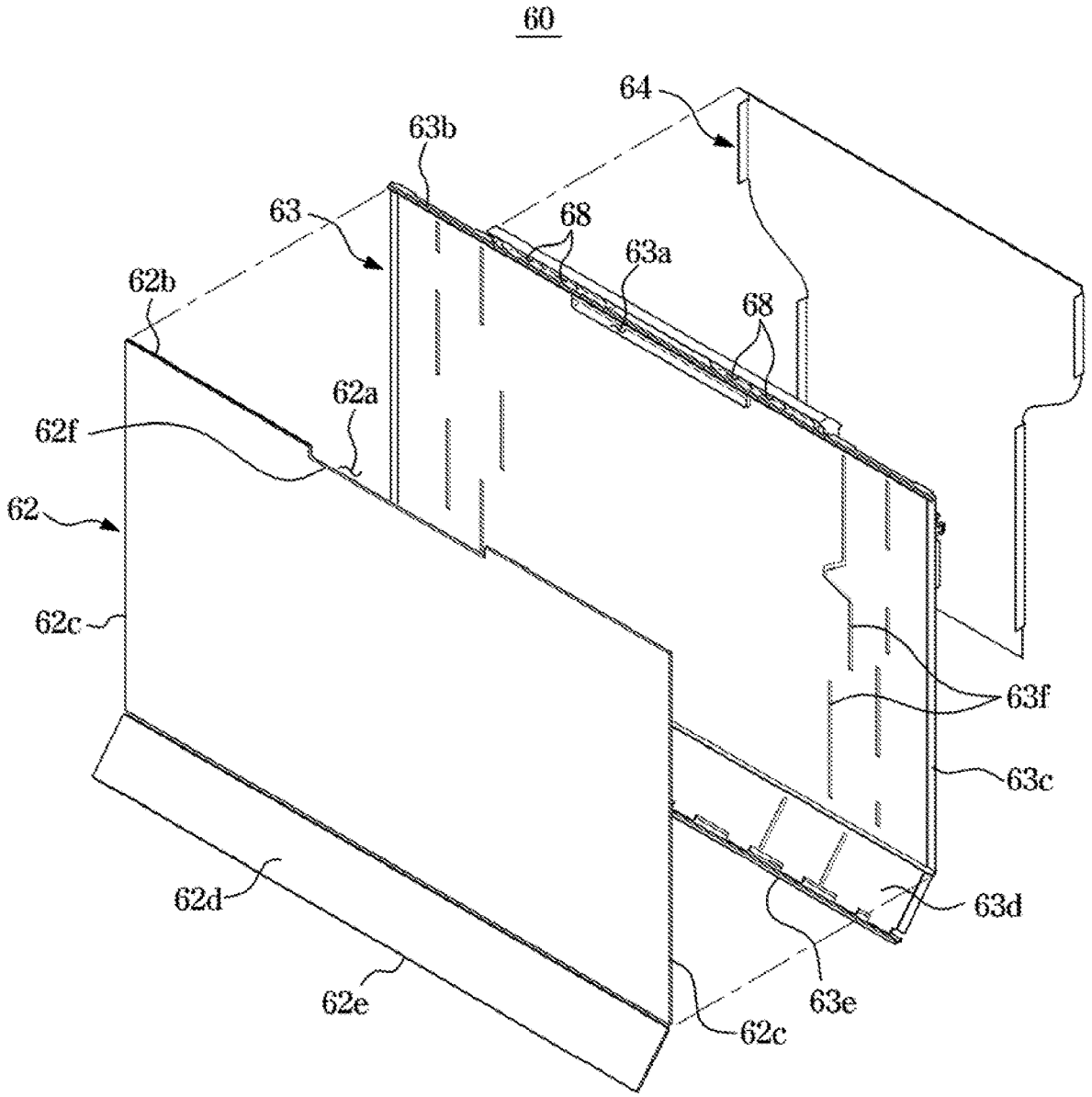
FIG. 5 is an exploded view of a rear guide of the refrigerator of FIG. 1.
Figure 6:
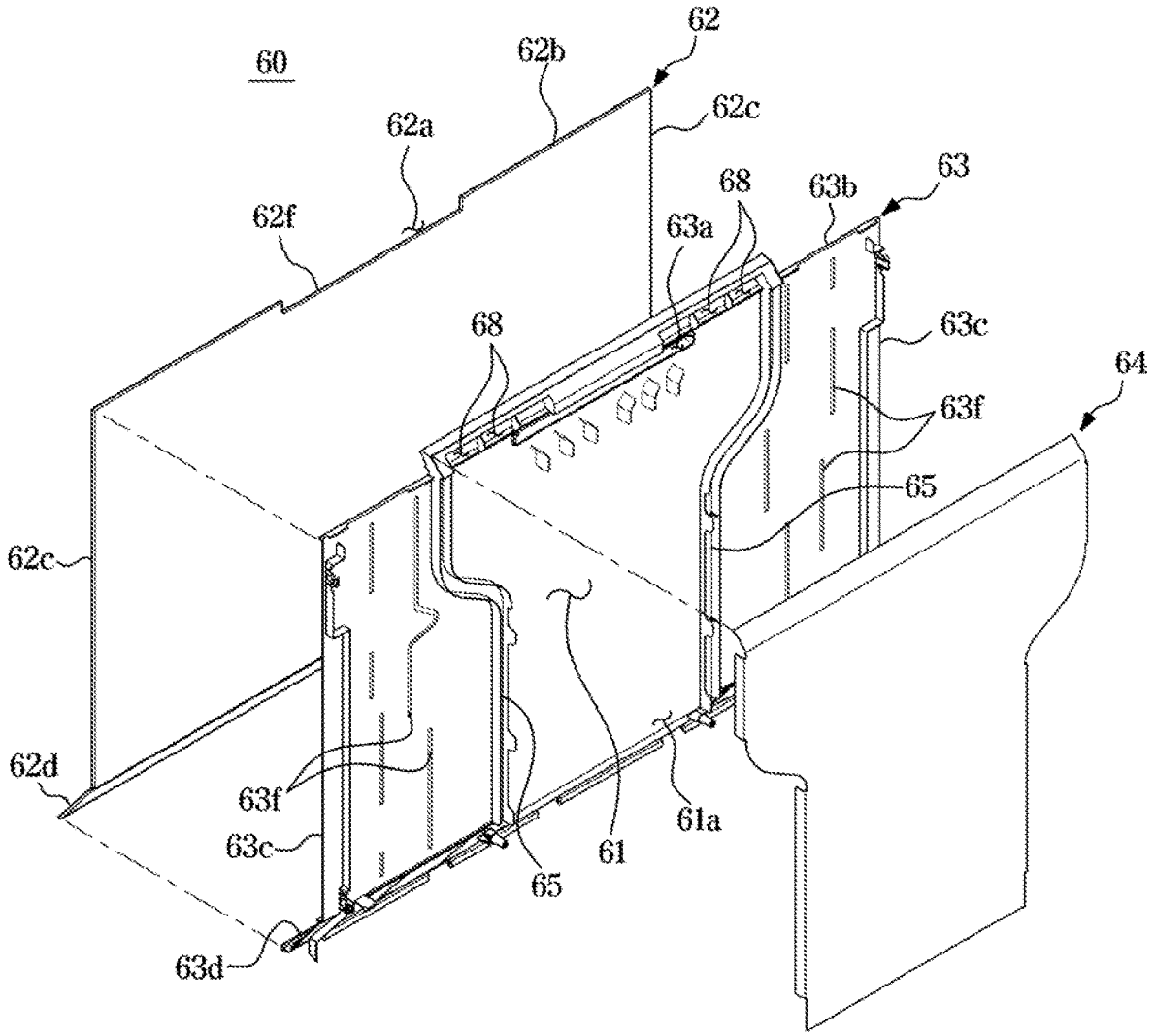
FIG. 6 is an exploded view of a rear guide of the refrigerator of FIG. 1, which is viewed from behind.

FIG. 5 is an exploded view of the rear guide of the refrigerator of FIG. 1. FIG. 6 is an exploded view of the rear guide of the refrigerator of FIG. 1, which is viewed from behind.

Referring to FIGS. 5 and 6, the rear guide 60 may include the front cover 62, the middle cover 63, the rear cover 64, and the cold air supply port 62*a* and 63*a*.

The cold air supply port 62*a* and 63*a* may include the front cold air supply port 62*a* and the middle cold air supply port 63*a*. The front cover 62 may include the front cold air supply port 62*a*. The middle cover 63 may include the middle cold air supply port 63*a*.

The front cover 62 may have a surface facing the storeroom 21. The front cover 62 may include a top end 62*b*, both side ends 62*c*, a bottom end 62*e*, and a bending part 62*d*. The front cover 62 may include a cut 62*a* formed inwards from the top end 62*b* of the front cover 62. The cut 62*a* may serve as a front cold air supply port 62*a*. In other words, the top end 62*b* may be cut inwards to form the front cold air supply port 62*a*. The front cold air supply port 62*a* may be arranged to be adjacent to the top wall of the storeroom 21. It is not, however, limited thereto. For example, the front cold air supply port 62*a* may be formed by being cut inwards from both side ends 62*c* or from the bottom end 62*e* of the front cover 62. Also, the front cover 62 may include a recess 62*f*. The recess 62*f* may be recessed from one end 62*b*, 62*c* and 62*e* of the front cover 62. The recess 62*f* may form a cold air supply port 62*a*.

The front cold air supply port 62*a* may be recessed inwards from each of the ends 62*b*, 62*c*, and 62*e* of the front cover 62. Accordingly, there is no need for extra perforation to form the cold air supply port.

Although it is shown that the cut 62*a* is made inwards from the top end 62*b* of the front cover 62, it is not limited thereto and it may be formed by being cut inwards from either side end 62*c* or the bottom end. Alternatively, a plurality of cuts 62*a* may be formed.

The cut 62*a* is connected to the middle cold air supply port 63*a* when the front cover 62 is coupled to the middle cover 63, which will be described later, and then the cut 62*a* may perform the function of the front cold air supply port 62*a*.

As the front cold air supply port 62*a* is to be connected to the middle cold air supply port 63*a*, the front cold air supply port 62*a* and the middle cold air supply port 63*a* may be formed to have a matching shape. For example, the front cold air supply port 62*a* and the middle cold air supply port 63*a* may be formed to be long in the horizontal direction and short in the vertical direction. Furthermore, the front cold air supply port 62*a* and the middle cold air supply port 63*a* may be formed in the same size.

In an embodiment of the disclosure, as the front cold air supply port 62*a* is formed by being cut inwards from the end 62*b*, 62*c* or 62*e* or the bending part 62*d* of the front cover 62, no extra post-processing is required after the cover is formed. Accordingly, processing and production costs may be reduced. In a case that the front cover 62 is formed of a glass material, when the cold air supply port 62*a* is formed by perforating the inside glass after the front cover 62 is formed, strength of the front cover 62 may be significantly reduced. In the embodiment of the disclosure, however, the cold air supply port 62*a* is formed by being cut from an end of the front cover 62, so there is no need for extra perforation and the strength of the front cover 62 may be maintained.

The middle cover 63 may be arranged between the front cover 62 and the rear cover 64. The middle cover 63 may include a top end 63*b*, both side ends 63*c*, a bending part 63*d*, and a bottom end 63*e*.

The middle cover 63 may also include the middle cold air supply port 63*a*, deformation relief grooves 63*f*, middle guide walls 65, and communication holes 68.

The middle cold air supply port 63*a* may be formed at an end of the middle cover 63. In other words, it may be formed at an edge of the middle cover 63. The middle cold air supply port 63*a* may receive cold air produced from the evaporator 3 and send the cold air to the front cold air supply port 62*a*. Furthermore, the front cold air supply port 62*a* and the middle cold air supply port 63*a* may be connected.

The deformation relief grooves 63*f* may be formed on the inner side of the middle cover 63 (i.e., a side facing the storeroom 21). The deformation relief grooves 63*f* may be provided to prevent the middle cover 63 from being destroyed when the size of the middle cover 63 is changed due to changes in temperature in the refrigerator 1. That is, the deformation relief grooves 63*f* may relieve shock from the change in size.

The middle guide walls 65 may guide the cold air to flow in between the top guide walls 74. The air that has passed through the middle guide walls 65 may flow to the middle cold air supply port 63*a* and the communication hole 68.

The middle guide walls 65 may form the communication hole 68. The communication hole 68 may allow the cold air to flow from the middle guide walls 65 to the top guide walls 74. The communication hole 68 may be arranged to be adjacent to the middle cold air supply port 63*a*. For example, the communication hole 68 may be arranged farther up than the middle cold air supply port 63*a*. Hence, some of the cold air produced from the evaporator 3 may be supplied to the middle cold air supply port 63*a* and some others may be supplied to the communication hole 68. The cold air flowing to the communication hole 68 may be supplied to the cold air guide 90.

The communication hole 68 may allow the cold air flowing to the rear guide 60 to flow to the top guide 70. That is, the communication hole 68 may connect the rear fluid path 61 to the top fluid path 71. With this, the cold air that has passed through the top fluid path 71 may be supplied to the cold air guide 90.

Although the communication hole 68 is shown to have a plurality of holes, it is not limited thereto and it may be formed as a single hole, which is formed to be longer in one direction.

A longer side of the middle cold air supply port 63*a* may be greater than the longer side of the communication hole 68. It is not, however, limited thereto, and the longer side of the communication hole 68 may be greater than the longer side of the middle cold air supply port 63*a*.

As described above, the damper 75 may be arranged in the downstream of the communication hole 68 to regulate the cold air flowing to the top guide walls 74 and the cold air guide 90.

The rear cover 64 may be arranged behind the middle cover 63. The rear cover 64 may have a size and a shape matching the middle guide wall 65. The middle cover 63 and the rear cover 64 may be coupled to form a duct that allows the cold air to flow therein. Furthermore, the middle guide walls 65 and the rear cover 64 may form the rear fluid path 61 in which the cold air flows. Although the rear cover 64 is shown to correspond to the shape of the middle guide walls 65, it is not limited thereto and the rear cover 64 may be formed to cover the entire middle cover 63.

The cold air supply port 62*a* and 63*a* may be formed to be longer in the horizontal direction than in the vertical direction. Accordingly, the cold air supply port 62*a* and 63*a* is hardly noticeable to the user, thereby improving aesthetic properties.

The front cover 62 may be formed to supply cold air into the storeroom 21 through the front cold air supply port 62*a*. Other components than the cold air supply port 62*a* may not supply the cold air into the storeroom 21. In other words, no multiple supply ports or holes are formed on inner portions of the front cover 62, and the cold air may be supplied into the storeroom 21 through the front cold air supply port 62*a* formed at the respective ends 62*b*, 62*c*, and 62*e* of the front cover 62. Furthermore, without perforating the front cover 62, the multiple cold air supply ports 62*a* may be formed by being cut from the respective ends 62*b*, 62*c* and 62*e*. Accordingly, the beauty of an area visible to the user may increase.

Figure 7:
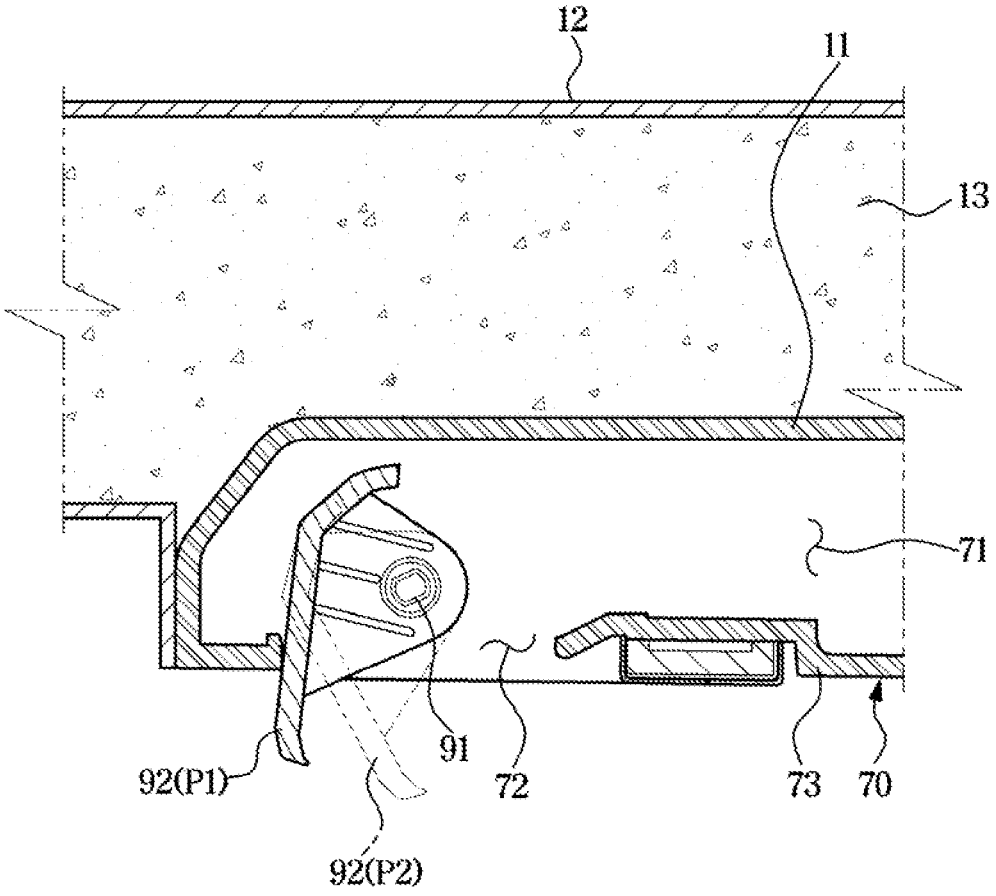
FIG. 7 is a diagram illustrating an operation of a cold air guide of the refrigerator of FIG. 1.
Figure 8:
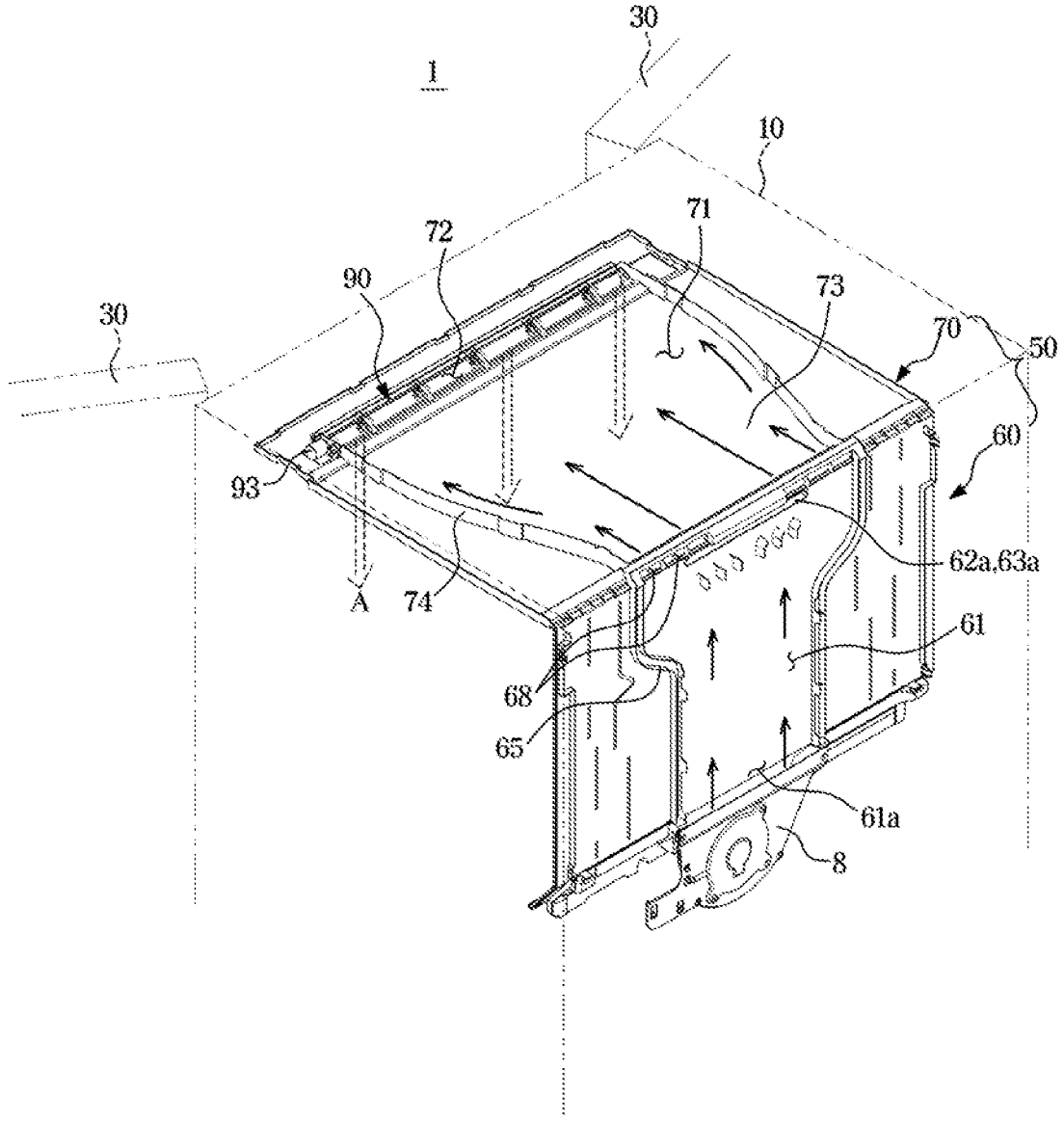
FIG. 8 illustrates an operating state of the cold air guide when a door of the refrigerator of FIG. 1 is opened.
Figure 9:
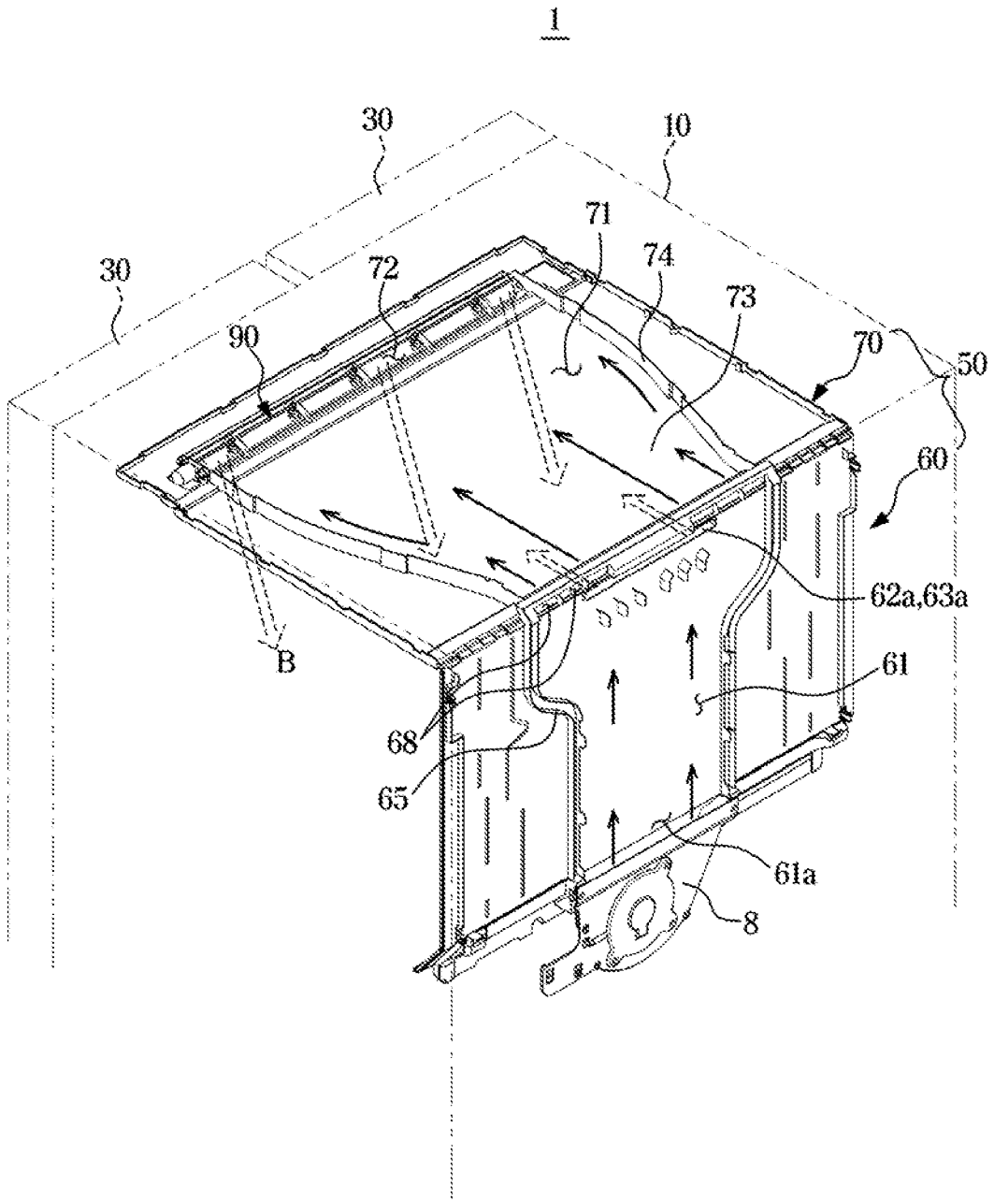
FIG. 9 illustrates an operating state of the cold air guide when the door of the refrigerator of FIG. 1 is closed.

FIG. 7 is a diagram illustrating an operation of a cold air guide of the refrigerator of FIG. 1. FIG. 8 illustrates an operating state of the cold air guide when the door of the refrigerator of FIG. 1 is opened. FIG. 9 illustrates an operating state of the cold air guide when the door of the refrigerator of FIG. 1 is closed.

Referring to FIGS. 7 to 9, the cold air guide 90 may be rotationally coupled to the discharge port 72 to open or close the discharge port 72. The discharge port 72 may be formed on the top wall of the storeroom 21. The cold air guide 90 may include a cold air guide body 92 and a rotation shaft 91, and the rotation shaft 91 may be coupled to a motor 93 from which to receive a rotational force. The top guide 70 may be coupled to the motor 93. The body 92 may be the blade 92. In another embodiment of the disclosure, some of the components may be omitted. For example, the cold air guide 90 may be comprised of the rotation shaft 91 and the body 92 without the motor 93. Furthermore, the blade 92 may be replaced by a blower fan (not shown). It is not, however, limited thereto, and an extra blower fan (not shown) may be arranged in an upstream of the cold air flowing to the blade 92 to regulate a rate of flow of the cold air.

As shown in FIG. 7, the cold air guide 90 may perform an air curtain function. The cold air guide 90 may be rotated between a first position P1 at which to open the discharge port 72 to form the air curtain when the door 30 is opened, and a second position P2 at which to send the cold air supplied through the cold air supply port 62*a* and 63*a* to the second, third, and fourth spaces 21*b*, 21*c*, and 21*d* by controlling a degree of opening or closing of the discharge port 72 when the door 30 is closed.

As shown in FIG. 8, when the blower fan 6 is rotated when the cold air guide 90 is in the first position P1, the cold air cooled by the evaporator 3 in the cooling room 3*a* may be discharged down through the discharge port 72 via the rear fluid path 61 and the top fluid path 71, forming an air curtain across the open front of the storeroom 21.

In this case, to increase an amount of cold air discharged through the discharge port 72 by minimizing an amount of cold air discharged through the cold air supply port 62*a* and 63*a*, the blower fan 6 may be rotated at a higher speed than for cooling the storeroom 21.

In the storeroom cooling mode in which the blower fan 6 is rotated while the cold air guide 90 blocks the discharge port 72, the blower fan 6 may be rotated at a first speed, and in the air curtain mode in which the blower fan 6 is rotated while the cold air guide 90 opens the discharge port 72, the blower fan 6 may be rotated at a second speed higher than the first speed.

The cold air guide 90 may form an air curtain by discharging cold air to the open front of the storeroom 21 through the discharge port 72. In the air curtain mode, the cold air may be prevented from leaking out of the storeroom 21 and air outside the storeroom 21 may be prevented from flowing into the storeroom 21 when the door 30 is opened.

Using the cold air guide 90 may not only allow uniform temperature distribution in the storeroom 21 but also enable the storeroom 21 to be cooled faster.

When the user opens the door 30, wet air may flow into the storeroom 21, forming water vapor on the front cover 62. When the cold air guide 90 is used, cold air is uniformly distributed in the storeroom 21, thereby reducing an amount of water vapor formed on the front cover 62.

As shown in FIG. 9, the cold air guide 90 may be in the second position P2 to control the degree of opening or closing of the discharge port 72. In this case, when the blower fan 6 is rotated, the cold air cooled by the evaporator 3 in the cooling room 3*a* may pass through the rear fluid path 61 and the top fluid path 71 and may then be discharged into the storeroom 21 through the discharge port 72. Accordingly, the cold air supplied through the cold air supply port 62*a* and 63*a* may be distributed or circulated throughout the second space 21*b*, third space 21*c*, and fourth space 21*d*.

The discharge port 72 is opened all the time, and the cold air guide 90 may control the degree of opening or closing of the discharge port 72 to form an air curtain or to supply the cold air into a space in which the cold air supply port 62*a* and 63*a* is not formed. Accordingly, the cold air guide 90 may perform various functions.

For example, the blade 91 of the cold air guide 90 may make the discharge port 72 open all the time. It may be in the position P1 to form the air curtain when the door 30 is opened and in the position P2 to distribute the cold air in the storeroom when the door 30 is closed.

However, the blade 91 is not fixed only in the position P1 when the door is opened, nor fixed only in the position P2 when the door is closed. The blade 91 may be rotated at regular intervals to prevent formation of ice due to the cold air and moisture in the storeroom 21 and may then return to the original position P1 or P2. Furthermore, the blade 91 may be rotated to prevent the formation of ice even when the user opens the door 30 for a long time. As the blade 91 returns to the original position after being rotated at regular intervals, it may return to the original position from a position other than P1 and P2.

Figure 10:
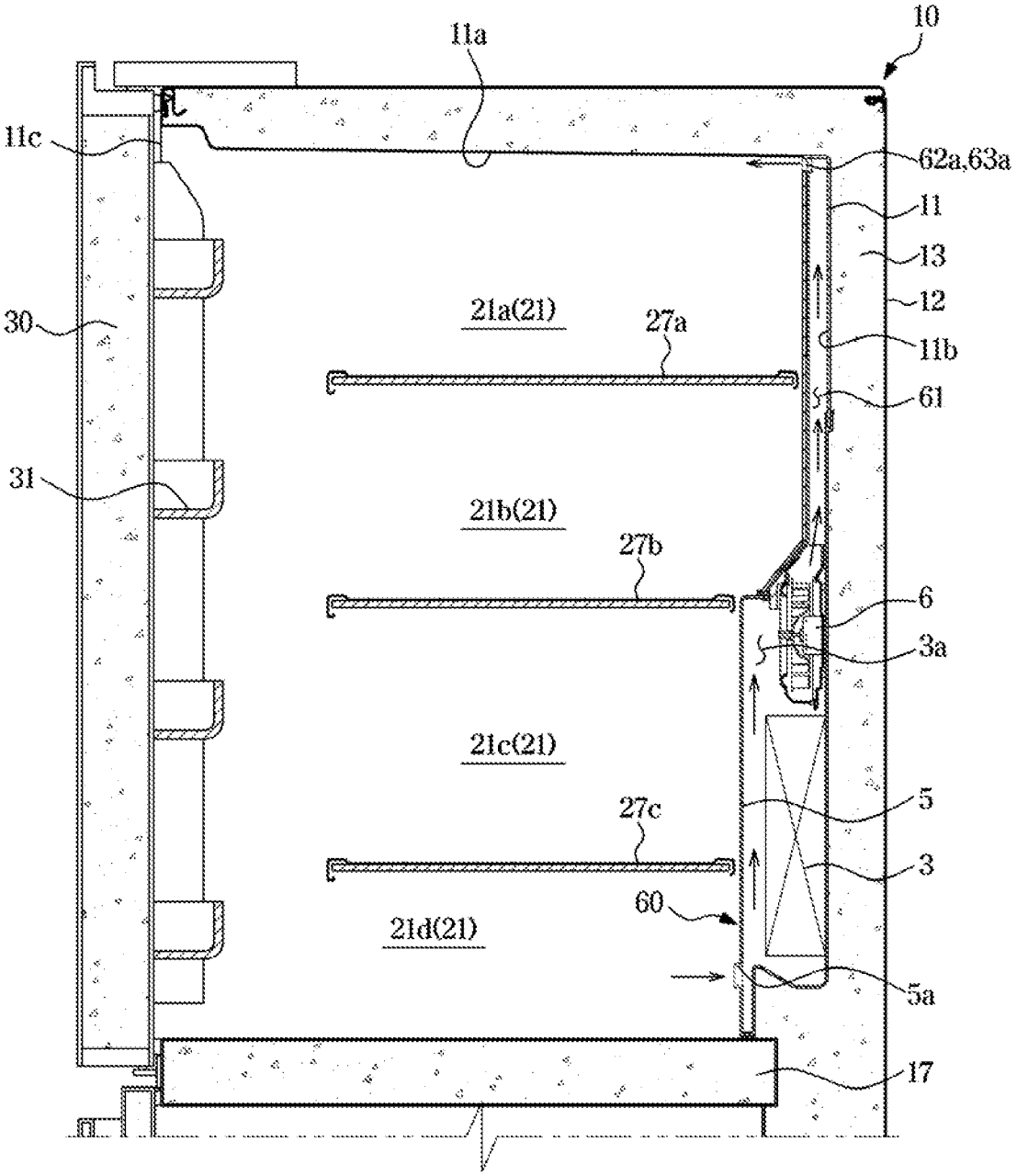
FIG. 10 is a schematic side cross-sectional view of a refrigerator, according to another embodiment of the disclosure.

FIG. 10 is a schematic side cross-sectional view of a refrigerator, according to another embodiment of the disclosure.

The same features as in the aforementioned embodiment are denoted by the same reference numerals, and the overlapping description will not be repeated.

Referring to FIG. 10, the cold air guide 90 may not be provided. The cold air supplied into the first space 21*a* through the cold air supply port 62*a* and 63*a* may be circulated throughout the second space 21*b*, third space 21*c*, and fourth space 21*d* without the cold air guide 90.

Specifically, as the air velocity of the cold air supplied into the storeroom 21 may increase the higher the rotation speed of the blower fan 6 is, the cold air may be supplied into the second, third, and fourth spaces 21*b*, 21*c*, and 21*d* by increasing the rate of the cold air coming out of the cold air supply port 62*a* and 62*b*. With this structure, groceries not only in the first space 21*a* but also in the second space 21*b*, third space 21*c*, and fourth space 21*d* may be kept fresh.

Figure 11:
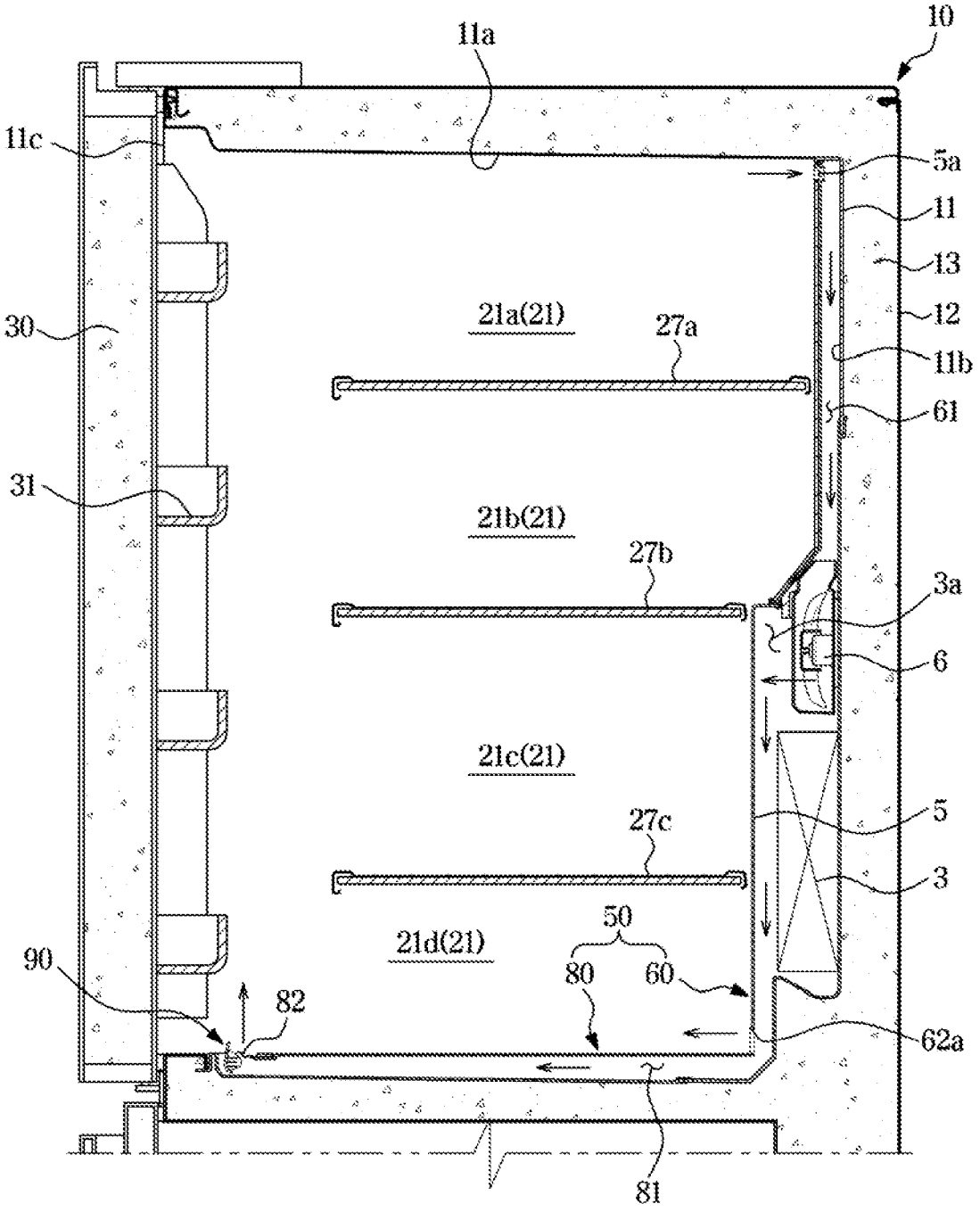
FIG. 11 is a schematic side cross-sectional view of a refrigerator, according to another embodiment of the disclosure.
Figure 12:
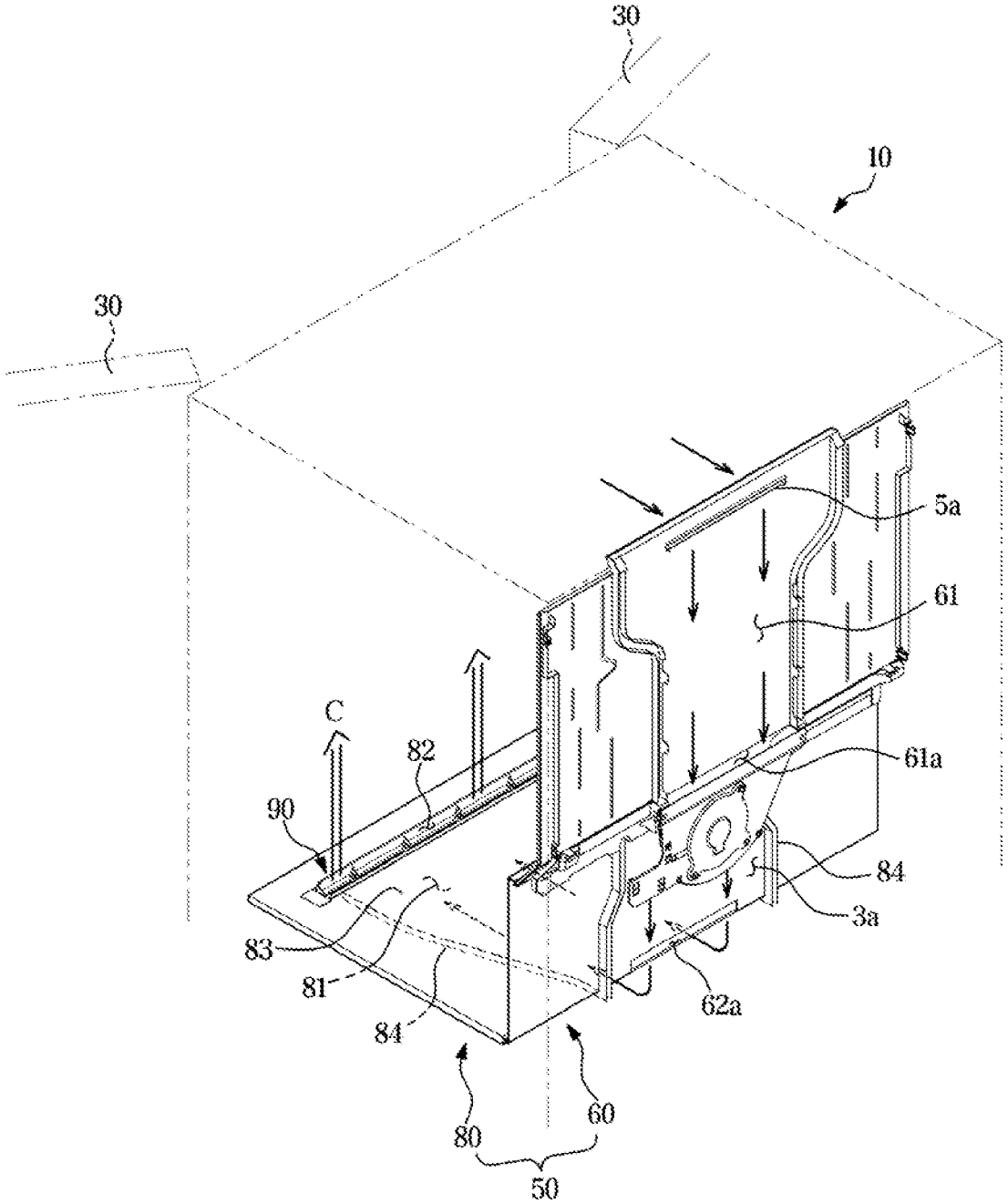
FIG. 12 illustrates an operating state of the cold air guide when the door of the refrigerator of FIG. 11 is opened.
Figure 13:
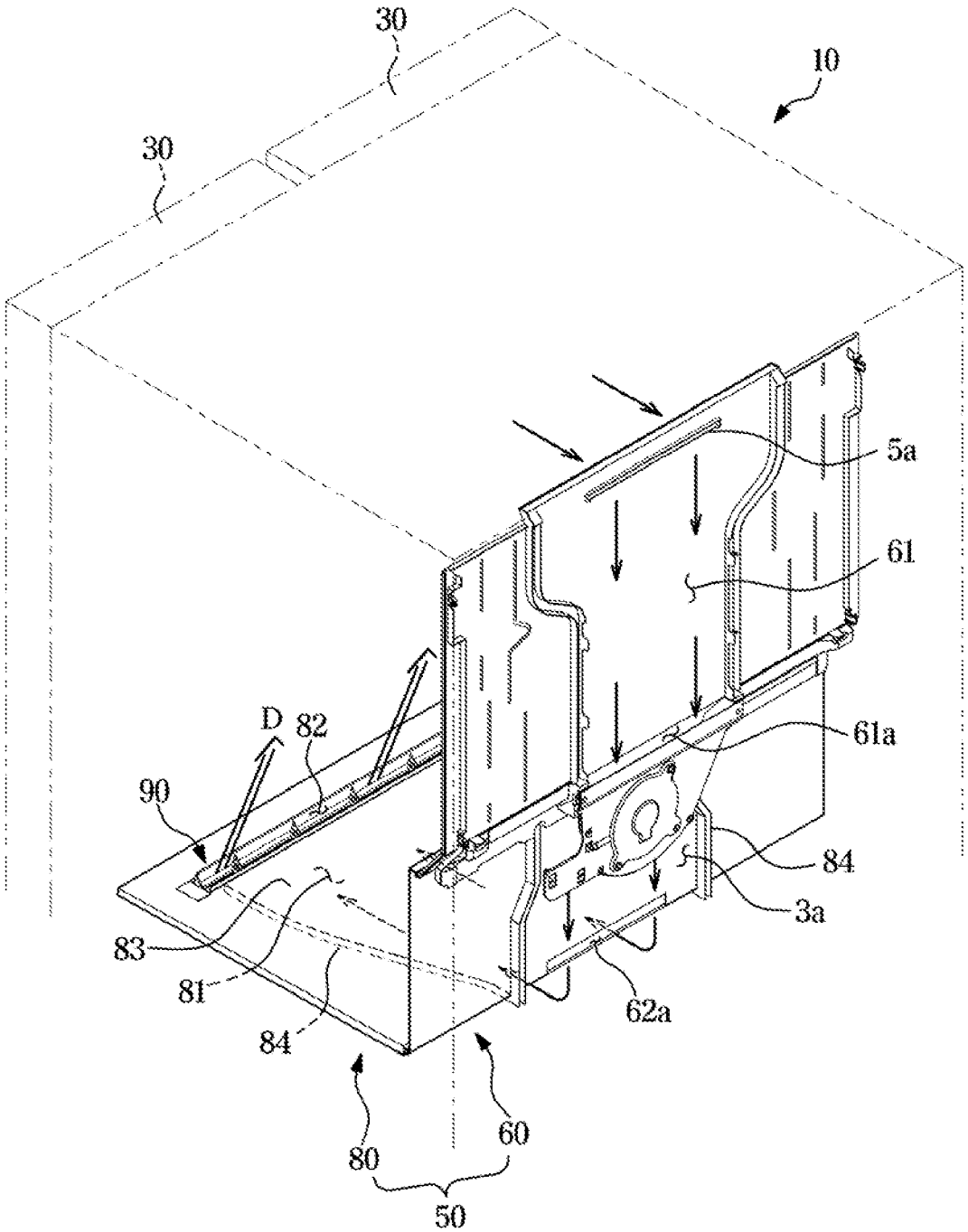
FIG. 13 illustrates an operating state of the cold air guide when the door of the refrigerator of FIG. 11 is closed.

FIG. 11 is a schematic side cross-sectional view of a refrigerator, according to another embodiment of the disclosure. FIG. 12 illustrates an operating state of a cold air guide when a door of the refrigerator of FIG. 11 is opened. FIG. 13 illustrates an operating state of the cold air guide when the door of the refrigerator of FIG. 11 is closed.

The same features as in the aforementioned embodiment are denoted by the same reference numerals, and the overlapping description will not be repeated.

Referring to FIGS. 11 to 13, the rear guide 60 may include the evaporator cover 5. Furthermore, the suction port 5*a* may be provided in a top portion of the storeroom 21, and the cold air supply port 62*a* and 63*a* may be provided in a bottom portion of the storeroom 21. In this case, air may flow to the evaporator 3 through the suction port 5*a* provided to suck air from the first space 21*a*, and cold air produced from the evaporator 3 may be discharged through the cold air supply port 62*a* and 63*a* connected to the fourth space 21*d* and supplied to the storeroom 21.

The cold air supply port 62*a* and 63*a* may be arranged at the bottom end of the evaporator cover 5. The cold air supply port 62*a* and 63*a* may be formed by being cut from the bottom end of the evaporator cover 5. Specifically, the cold air supply port 62*a* and 63*a* may be recessed inwards from the bottom end of the evaporator cover 5. Accordingly, the cold air may be supplied to the fourth space 21*d*. As described above, as the cold air supply port 62*a* and 63*a* is formed by being cut at an end, extra post-processing is not required after the cover is formed. Accordingly, processing and production costs may be reduced.

The discharge port 72 and the cold air guide 90 may also be arranged on the bottom of the storeroom 21. Accordingly, the cold air coming through the cold air supply port 62*a* and 63*a* formed at the bottom of the evaporation cover 5 may be distributed or circulated throughout the first space 21*a*, second space 21*b*, and third space 21*c*.

However, the cold air guide 90 is not an essential component to regulate cold air supplied into the storeroom through the cold air supply port 62*a* and 63*a*. Even without the cold air guide 90, the cold air may be supplied into the first space 21*a*, second space 21*b*, and third space 21*c* by regulating the amount of cold air coming through the cold air supply port 62*a* and 63*a*. This may keep groceries in the storeroom fresh.

The cold air guide assembly 50 may further include a bottom guide 80. The cold air in the rear cover 64 may flow to the bottom guide 80. The cold air flowing to the bottom guide 80 may pass through a third guide fluid path 81 and may then be supplied to a discharge port 82. The third guide fluid path 81 may be a bottom fluid path 81.

The bottom guide 80 may include the third guide fluid path 81 connected to the rear fluid path 61, and the discharge port 82 through which to discharge the cold air up into the storeroom 21 from the third guide fluid path 81 to supply the cold air to the first, second, and third spaces 21*a*, 21*b* and 21*c* of the storeroom 21.

The bottom guide 80 may also include a cover bottom 83 that separates the storeroom 21 from the third guide fluid path 81, and a pair of bottom guide walls 84 arranged to protrude down from the cover bottom 83 and face each other to form the third guide fluid path 81.

The bottom guide 80 may be coupled onto the bottom side of the inner case 21 that defines the storeroom 21, and the third guide fluid path 81 may be surrounded by the cover bottom 83, the pair of bottom guide walls 84, and the inner case 11. Alternatively, there may be an extra cover member (not shown) arranged between the bottom guide 80 and the inner case 11, in which case the third guide fluid path 81 may be surrounded by the bottom guide 80, the pair of bottom guide walls 84, and the cover member.

As shown in FIG. 12, when the blower fan 6 is rotated after the rotation shaft 91 and the body 92 of the cold air guide 90 are rotated into the first position P1 (see FIG. 7), i.e., the degree of opening is large, the cold air cooled by the evaporator 3 in the cooling room 3*a* may be discharged up through the discharge port 82 via the rear fluid path 61 and the third guide fluid path 81 to form an air curtain across the open front of the storeroom 21.

As shown in FIG. 13, when the blower fan 6 is rotated after the rotation shaft 91 and the body 92 of the cold air guide 90 are rotated into the second position P2 (see FIG. 7), i.e., the degree of opening is small, the cold air cooled by the evaporator 3 in the cooling room 3*a* may be discharged into the storeroom 21 through the cold air supply port 62*a* and 63*a* from the rear fluid path 61 and be sent into the first, second, and third spaces 21*a*, 21*b*, and 21*c*.

Figure 14:
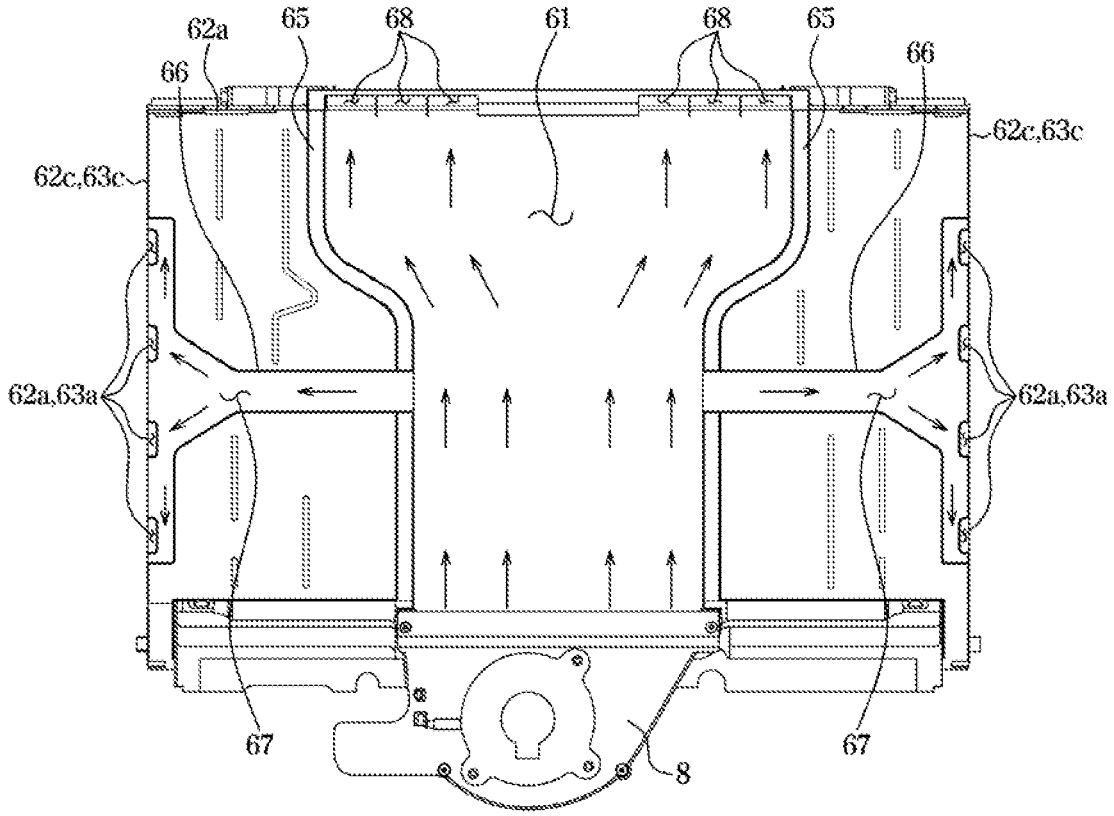
FIG. 14 illustrates a rear cover in a refrigerator, according to another embodiment of the disclosure.
Figure 15:
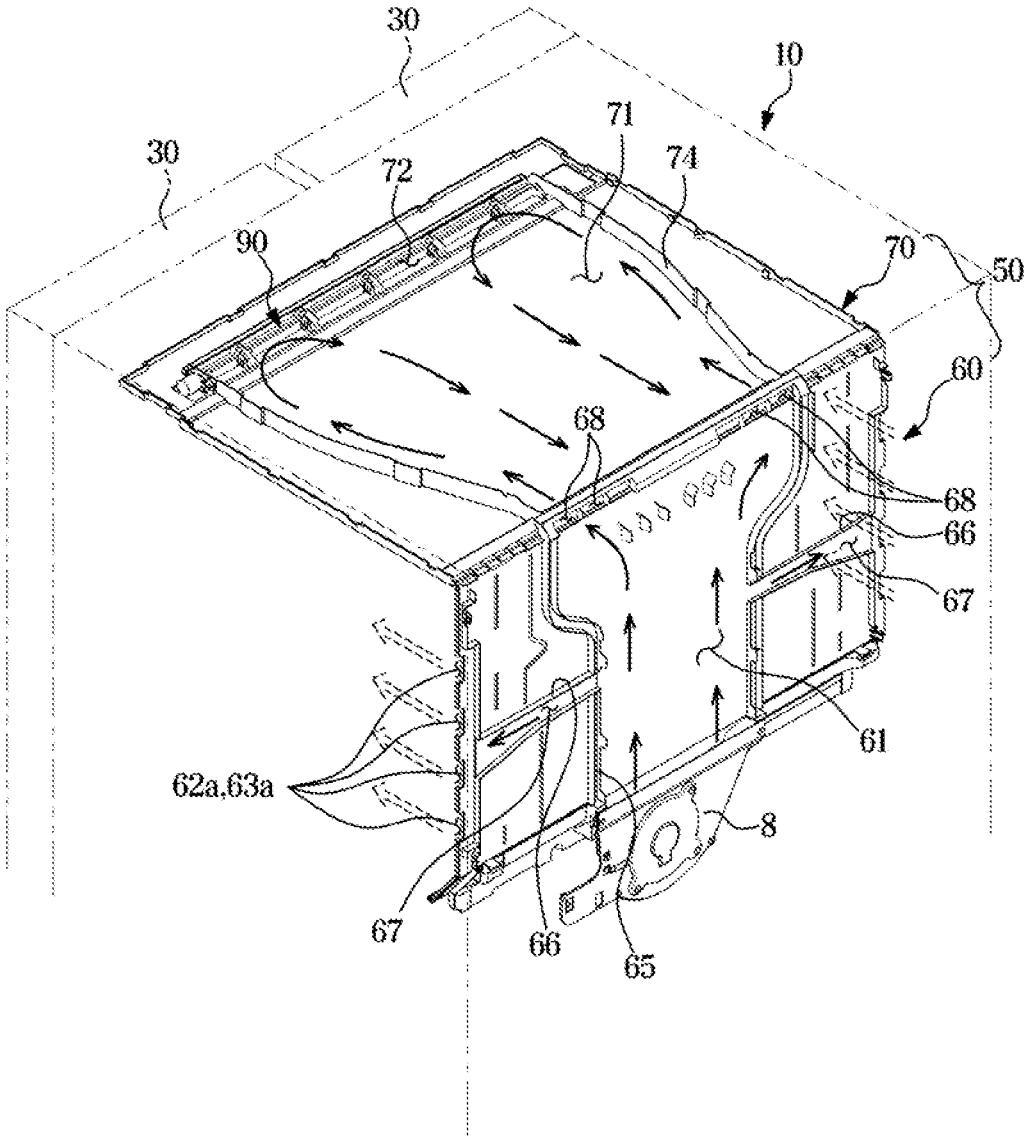
FIG. 15 illustrates an operating state of a rear guide when the door of the refrigerator of FIG. 14 is closed.

FIG. 14 illustrates a rear cover in a refrigerator, according to another embodiment of the disclosure. FIG. 15 illustrates an operating state of a rear guide when the door of the refrigerator of FIG. 14 is closed.

The same features as in the aforementioned embodiment are denoted by the same reference numerals, and the overlapping description will not be repeated.

Referring to FIGS. 14 and 15, the middle cover 63 may further include extension guide walls 66. The extension guide walls 66 may protrude backwards from the middle cover 63. The extension guide walls 66 may be connected to the middle guide walls 65. The extension guide walls 66 may extend to both sides from the middle guide walls 65. The extension guide walls 66 may allow the cold air supply port 62*a* and 63*a* to be formed at both side ends of the middle cover 63. Although not shown, as the middle cold air supply port 63*a* is formed at the side end of the middle cover 63, the front cold air supply port 62*a* is, of course, formed at the corresponding side end of the front cover 62.

The extension guide walls 66 may form an extension fluid path 67 to supply the cold air to the side ends of the rear guide 60.

In an embodiment of the disclosure, the suction port 5*a* may be provided in a bottom portion of the storeroom 21, and the cold air supply port 62*a* and 63*a* may discharge the cold air near to the sides of the storeroom 21. Specifically, air may flow to the evaporator 3 through the suction port 5*a* formed on the bottom of the storeroom 21, and cold air produced from the evaporator 3 may be discharged through the cold air supply port 62*a* and 63*a* formed at side ends of the rear guide 60 and supplied to the storeroom 21.

It is not, however, limited thereto. For example, the suction port 5*a* may be arranged on the top of the storeroom 21 so that the cold air may be discharged into the storeroom 21 through the cold air supply port 62*a* and 63*a* formed at sides of the rear guide 60. In this case, unlike what is shown in FIG. 13, the evaporator 3 and the blower fan 6 may be arranged in an upper portion behind the storeroom 21.

The cold air supply port 62*a* and 63*a* may be arranged at the side ends of the rear guide 60. The cold air supply port 62*a* and 63*a* may be formed by being cut from the both side ends of the rear guide 60. That is, the cold air supply port 62*a* and 63*a* may be recessed inwards from the both side ends of the rear guide 60.

Although it is shown that the cold air guide 90 is not operating, it is not limited thereto but the cold air guide 90 may be used to circulate the cold air in the storeroom 21.

Furthermore, as described above, as the cold air supply port 62*a* and 63*a* is formed by being cut at an end, extra post-processing is not required after the cover is formed. Accordingly, processing and production costs may be reduced.

Although it is shown that the cold air supply port 62*a* and 63*a* are formed as a plurality of ports at either side end, it is not limited thereto but may be formed as a single port into which a plurality of ports are connected at either side end. In this case, the cold air supply port 62*a* and 63*a* may be formed to have a longer size in the vertical direction than in the horizontal direction.

Figure 16:
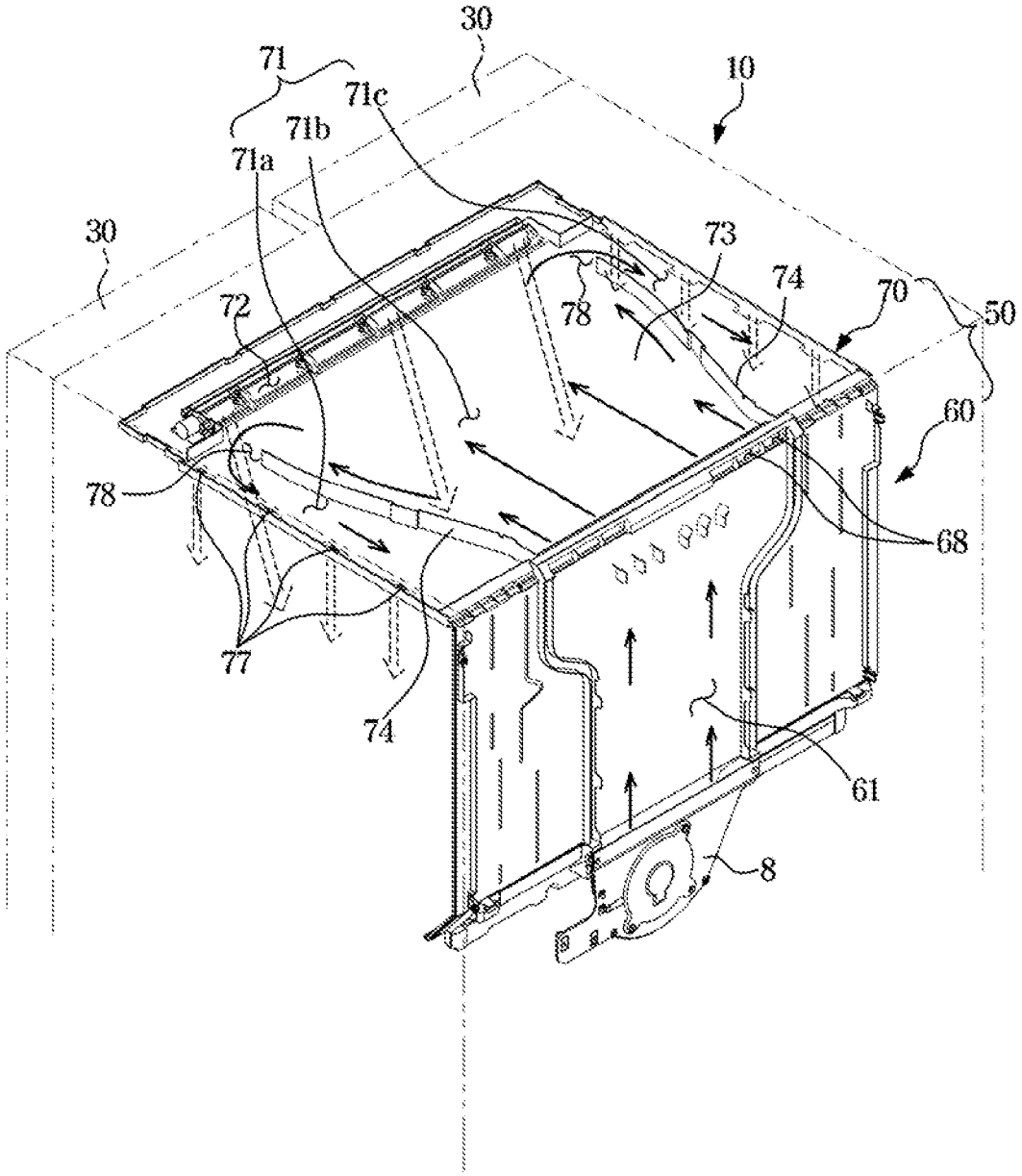
FIG. 16 illustrates an operating state of a rear guide when a door is closed in a refrigerator, according to another embodiment of the disclosure.

FIG. 16 illustrates an operating state of a rear guide when a door is closed in a refrigerator, according to another embodiment of the disclosure.

The same features as in the aforementioned embodiment are denoted by the same reference numerals, and the overlapping description will not be repeated.

Referring to FIG. 16, the cold air guide assembly 50 may include a rear guide 60 arranged behind the storeroom 21 and a top guide 70 arranged on top of the storeroom 21.

The rear guide 60 may include the rear fluid path 61 for guiding the cold air produced from an evaporator, and the cold air supply port 62*a* and 63*a* for supplying the cold air into the storeroom 21 from the rear fluid path 61 to cool down the storeroom 21.

The rear guide 60 may include the front cover 62 facing the storeroom 21, the middle cover 63 coupled onto the rear surface of the front cover 62, and the pair of middle guide walls 65 arranged to protrude from the middle cover 63 and face each other to form the rear fluid path 61.

The top guide 70 may include the top fluid path 71 connected to the rear fluid path 61, and the discharge port 72 through which to discharge the cold air down into the storeroom 21 from the top fluid path 71 to supply the cold air to the second, third, and fourth spaces 21*b*, 21*c* and 21*d* of the storeroom 21.

The top guide 70 may also include the cover top 73 that separates the storeroom 21 from the top fluid path 71, and the pair of top guide walls 74 arranged to protrude upwards from the cover top 73 and face each other to form the top fluid path 71.

Furthermore, the top guide 70 may include a cooling discharge port 77 through which to discharge cold air into the storeroom 21 from the top fluid path 71 to cool down the storeroom 21. Accordingly, in the embodiment of the disclosure, in the mode to cool down the storeroom 21, cold air may be discharged through both the cold air supply port 62*a* and 63*a* of the rear guide 60 and the cooling discharge port 77 of the top guide 70, thereby increasing cooling efficiency of the storeroom 21.

The top guide 70 may include a detour part 78 formed by cutting off the top guide walls 74 on the cover top 73 for the cold air flowing into the top fluid path 71 to detour to the cooling discharge port 77.

There may be a plurality of detour parts 78. For example, there may be two detour parts 78 on the left and right to partition the top fluid path 71 into a center portion 71*b* to which the cold air flows from the rear fluid path 61, a left portion 71*a* formed on the left of the center portion 71*b*, and a right portion 71*c* formed on the right of the center portion 71*b*.

The cooling discharge port 77 may be arranged in at least one of the left portion 71*a* or the right portion 71*c*. The cold air flowing into the top fluid path 71 detours to the detour part 78 to be discharged through the cooling discharge ports 77.

In this case, even when the cold air guide 90 is not operating, the temperature in the whole storeroom may be maintained due to the cold air supplied through the cold air supply port 62*a* and 63*a* and the cooling discharge port 77. Accordingly, the refrigerator may keep the groceries fresh and have an aesthetically enhanced appearance because the cooling discharge port 77 is hardly noticeable to the user.

Figure 17:
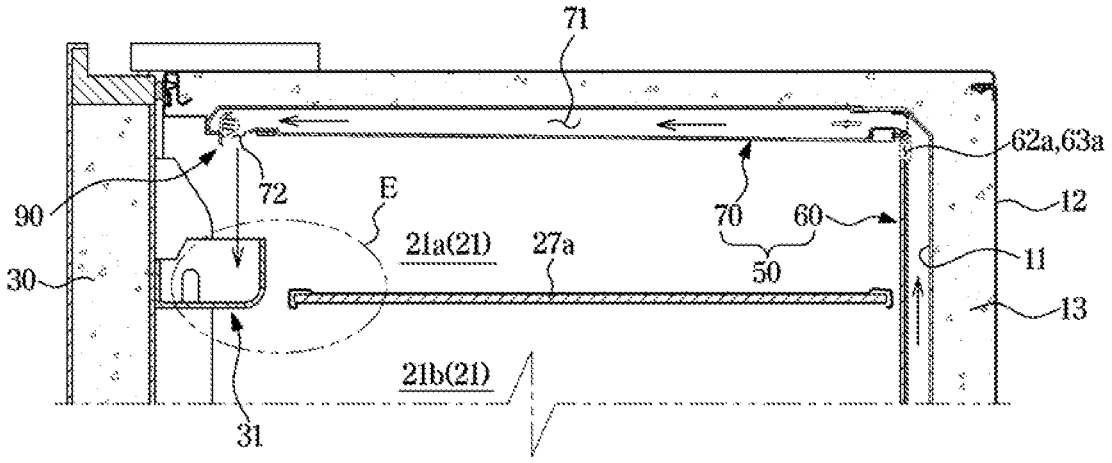
FIG. 17 illustrates a portion of a side cross-section of a refrigerator, according to another embodiment of the disclosure.
Figure 18:
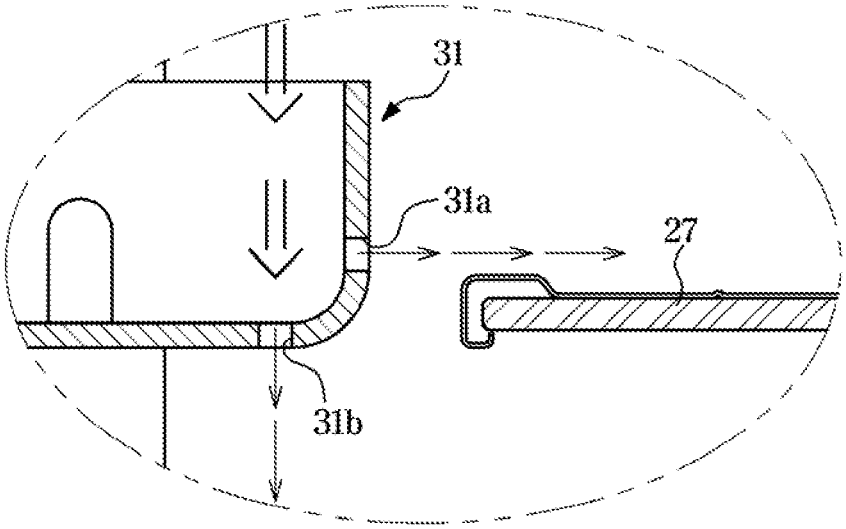
FIG. 18 illustrates section E of the refrigerator shown in FIG. 17.

FIG. 17 illustrates a portion of a side cross-section of a refrigerator, according to another embodiment of the disclosure. FIG. 18 illustrates section E of the refrigerator shown in FIG. 17.

Referring to FIGS. 17 and 18, the refrigerator may further include a plurality of door guards 31. Cold air discharged from the cold air guide 90 may flow toward the door guards 31. Each of the plurality of door guards 31 may include door guard holes 31*a* and 31*b*. The door guard holes 31*a* and 31*b* may include a rear hole 31*a* and a bottom hole 31*b*.

The rear hole 31*a* may be formed on the rear portion of the door guard 31. The rear hole 31*a* may allow the cold air discharged from the cold air guide 90 to flow onto the shelf 27 arranged behind the door guard 31.

The bottom hole 31*b* may be formed on the bottom portion of the door guard 31. The bottom hole 31*b* may allow the cold air discharged from the cold air guide 90 to flow to another one of the plurality of door guards 31 arranged below.

Although it is shown that there are the rear hole 31*a* and the bottom hole 31*b*, it is not limited to the holes but there may be a fluid path formed in an inner portion of the door guard 31.

With the rear hole 31*a* and the bottom hole 31*b*, the cold air may be uniformly distributed or circulated in the storeroom 21, thereby keeping groceries stored in the storeroom 21 fresh.

Figure 19:
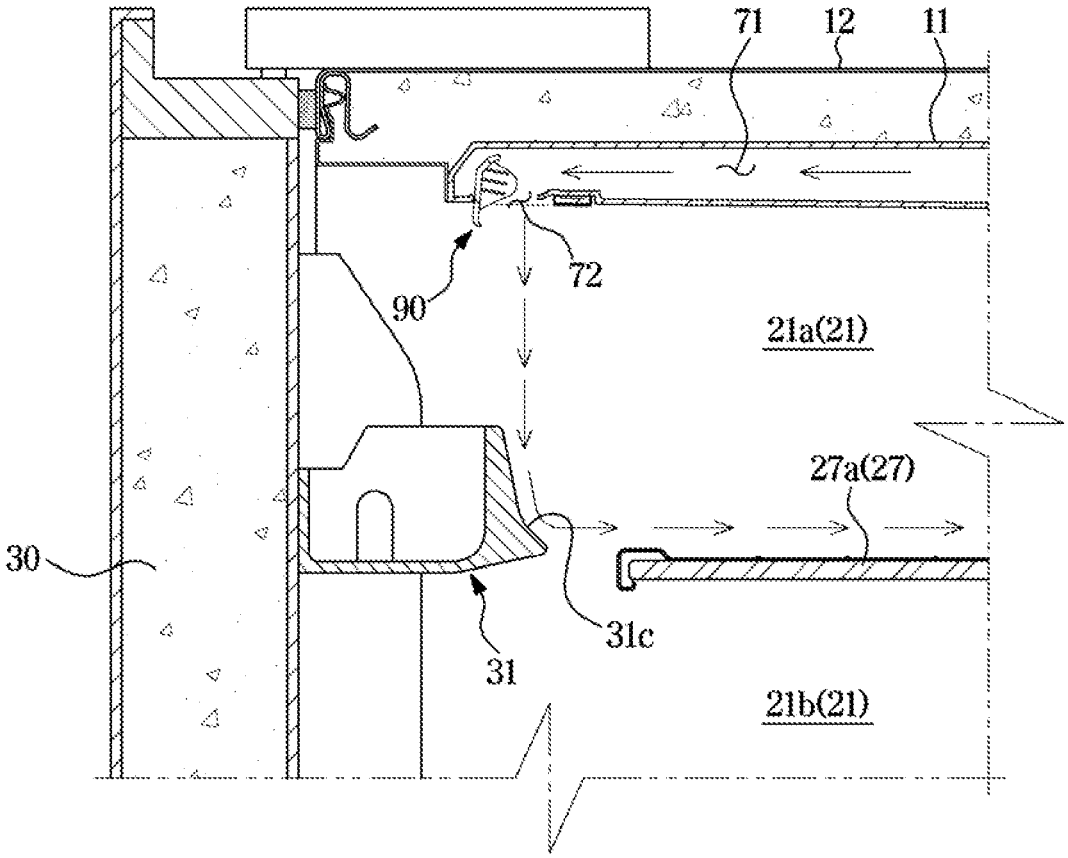
FIG. 19 illustrates a portion of a side cross-section of a refrigerator, according to another embodiment of the disclosure.

FIG. 19 illustrates a portion of a side cross-section of a refrigerator, according to another embodiment of the disclosure.

The same features as in the aforementioned embodiment are denoted by the same reference numerals, and the overlapping description will not be repeated.

Referring to FIG. 19, each of the plurality of door guards 31 may include a cold air direction guide 31*c*. The cold air direction guide 31*c* may cause the cold air discharged through the cold air supply port 62*a* and 63*a* and the discharge port 72 to be distributed in the storeroom 21.

The cold air direction guide 31*c* may cause the cold air discharged through the cold air supply port 62*a* and 63*a* and the discharge port 72 to flow onto the shelf 27.

The cold air direction guide 31*c* may have a curved shape so that the cold air flows onto the shelf 27. That is, the cold air direction guide 31*c* is formed as a curve for the cold air to flow onto the shelf 27. Accordingly, the groceries stored on the shelf 27 may be kept fresh.

Although it is shown that the cold air direction guide 31*c* is formed at the door guard 31 near a first shelf 27*a*, it is not limited thereto and the cold air direction guide 31*c* may be formed at each of the plurality of door guards 31. Depending on the shape of the cold air direction guide 31*c*, some of the cold air flows onto the shelf 27 and some of the cold air may flow down the storeroom 21. With this structure, the cold air may be distributed or circulated in the second space 21*b*, third space 21*c*, and fourth space 21*d*.

Figure 20:
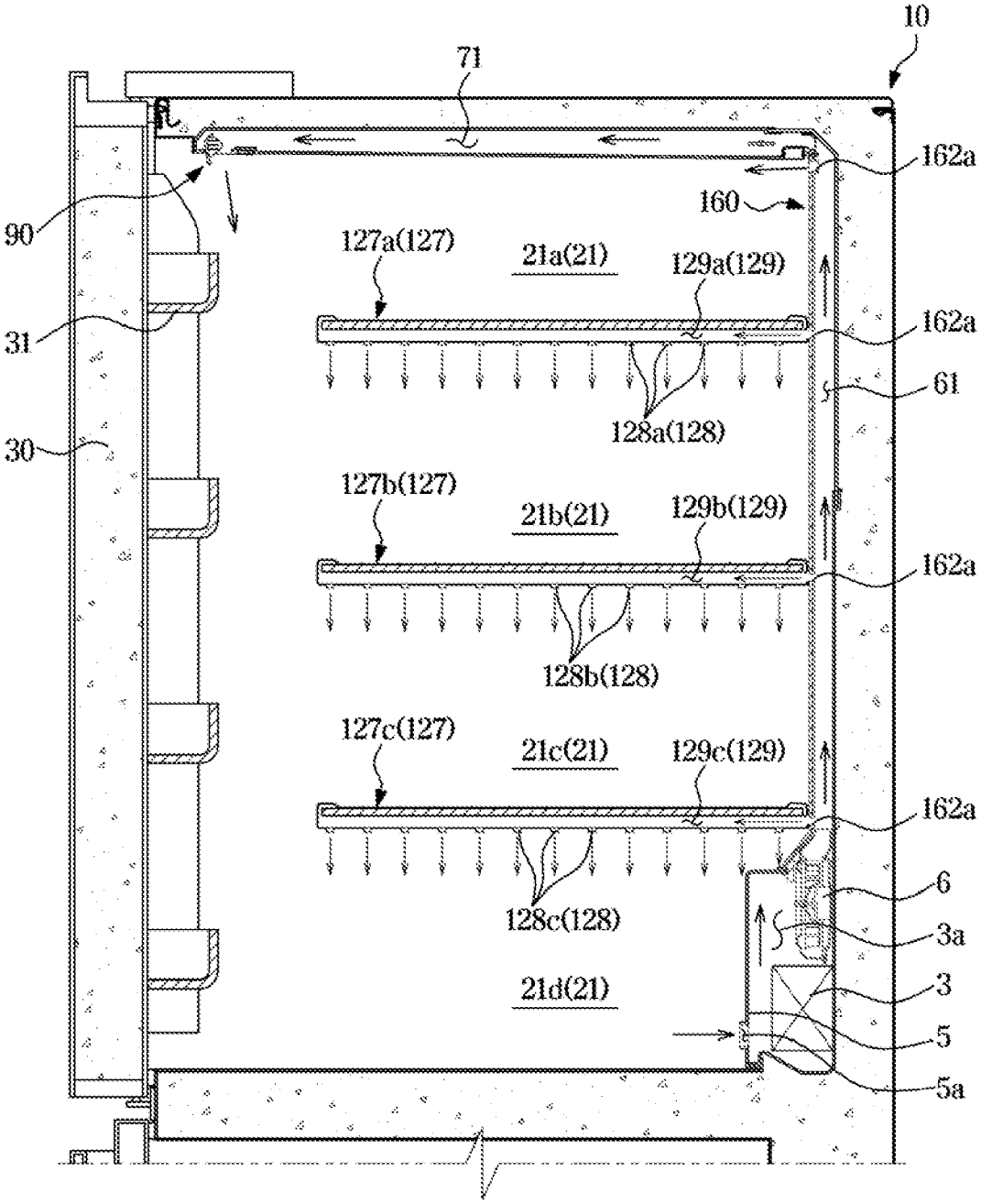
FIG. 20 illustrates a portion of a side cross-section of a refrigerator, according to another embodiment of the disclosure.

FIG. 20 illustrates a portion of a side cross-section of a refrigerator, according to another embodiment of the disclosure.

The same features as in the aforementioned embodiment are denoted by the same reference numerals, and the overlapping description will not be repeated.

Referring to FIG. 20, the refrigerator may further include a plurality of shelves 127. Each of the plurality of shelves 127 may be provided as a duct that forms a fluid path in which the cold air flows. That is, they may be formed as shelf ducts 127. In the embodiment of the disclosure, there may be a plurality of cold air supply ports 162*a*.

Each of the shelves 127 may include a cold air supply hole 128 and a shelf fluid path 129.

The shelf 127 may be connected to the cold air supply port 162*a* to receive the cold air. Specifically, the cold air produced from the evaporator 3 may flow into the shelf fluid path 129 through the rear fluid path 61 and the cold air supply port 162*a*. The cold air flowing into the shelf fluid path 129 may flow into the storeroom 21 through the cold air supply hole 128. The cold air supply hole 128 may be formed at the bottom of the shelf 127. The position at which the cold air supply hole 128 is formed is not limited thereto, and the cold air supply hole 128 may be formed on the top or front of the shelf 127 to supply the cold air.

Specifically, the first shelf 127*a* may supply the cold air that has passed through a first shelf fluid path 129*a* to the second space 21*b*. The second shelf 127*b* may supply the cold air that has passed through a second shelf fluid path 129*b* to the third space 21*c*. The third shelf 127*c* may supply the cold air that has passed through a third shelf fluid path 129*c* to the fourth space 21*d*. Furthermore, the cold air supply port 162*a* formed uppermost may supply the cold air into the first space 21*a*. In this case, the cold air may be circulated in the entire storeroom 21 without using the cold air guide 90. This may save unnecessary material costs and operation costs but may keep the groceries fresh. Furthermore, the cold air supply port 162*a* and the cold air supply hole 128 are hardly visible to the user, giving better aesthetic appearance.

Figure 21:
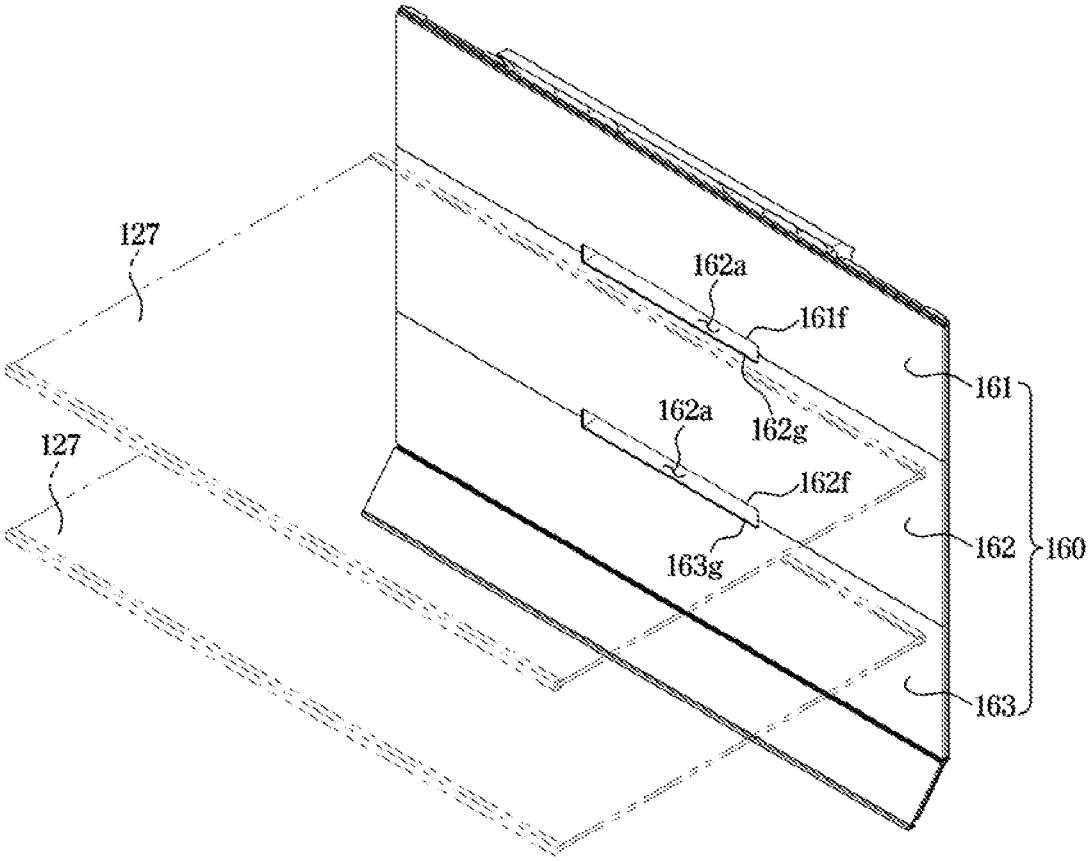
FIG. 21 illustrates shelves and a rear guide in a refrigerator, according to another embodiment of the disclosure.

FIG. 21 illustrates shelves and a rear guide in a refrigerator, according to another embodiment of the disclosure.

The same features as in the aforementioned embodiment are denoted by the same reference numerals, and the overlapping description will not be repeated.

Referring to FIG. 21, a front cover 160 may include a plurality of parts 161, 162, and 163. Specifically, the front cover 160 may include a first cover part 161, a second cover part 162, and a third cover part 163. The cover parts 161, 162, and 163 may be detachably coupled to one another.

The first cover part 161 may include a bottom recess 161*f* recessed upwards from the bottom end of the first cover part 161. The second cover part 162 may include a top recess 162*g* recessed downwards from the top end of the second cover part 162, and a bottom recess 162*f* recessed upwards from the bottom end of the second cover part 162. The third cover part 163 may include a top recess 163*g* recessed downwards from the top end of the third cover part 163.

The bottom recess 161*f* of the first cover part 161 and the top recess 162*g* of the second cover part 162 may form the cold air supply port 162*a*. The bottom recess 162*f* of the second cover part 162 and the top recess 163*g* of the third cover part 163 may also form the cold air supply port 162*a*. That is, in the embodiment of the disclosure, there may be a plurality of cold air supply ports 162*a* formed at the front cover 160.

Although it is shown that the cold air supply ports 162*a* are formed between the top recesses 162*g* and 163*g* and the bottom recesses 161*f* and 162*f*, it is not limited thereto. For example, the cold air supply ports 162*a* may include cuts formed on the outer circumference of each of the cover parts 161, 162, and 163. Specifically, the cold air supply ports 162*a* may be formed by being recessed upwards from the bottom ends of the respective cover parts 161, 162, and 163. Furthermore, the cold air supply ports 162*a* may be formed by being recessed downwards from the top ends of the respective cover parts 161, 162, and 163.

With this structure, the cold air supply ports 162*a* are hardly visible to the user as described above, so the refrigerator may maintain the aesthetic appearance while keeping the groceries in the storeroom 21 fresh with the cold air discharged through the cold air supply ports 162*a*.

Furthermore, although it is shown that the front cover 160 has three parts and there may be two cold air supply ports 162*a*, embodiments of the disclosure are not limited thereto and there are no limitations on the number.

The shelves 127 may be arranged in front of the respective cold air supply ports 162*a*. As the shelves 127 may be arranged in front of the respective cold air supply ports 162*a*, the cold air supply ports 162*a* are hardly visible to the user, so the refrigerator may maintain the aesthetic appearance and keep the groceries in the storeroom 21 fresh with the cold air discharged through the cold air supply ports 162*a*.

According to embodiments of the disclosure, a refrigerator having an enhanced design may be provided.

According to embodiments of the disclosure, a refrigerator having a reduced production cost may be provided.

Several embodiments of the disclosure have been described above, but a person of ordinary skill in the art will understand and appreciate that various modifications can be made without departing the scope of the disclosure. Thus, it will be apparent to those ordinary skilled in the art that the true scope of technical protection is defined by the following claims.

What is claimed is:

1. A refrigerator, comprising:
an outer case;
an inner case inside the outer case;
a storeroom formed inside the inner case;
a heat exchanger disposed adjacent to the storeroom to supply cold air; and
a cold air guide assembly to guide the cold air from the heat exchanger to the storeroom, the cold air guide assembly including:
a top guide disposed on top of the storeroom; and
a rear guide disposed behind the storeroom, and connected to the top guide at top of the rear guide to guide the cold air to the top guide, the rear guide including
a front cover defining a rear side of the storeroom, the front cover including wherein the front cover includes a recessed portion recessed from a top end of the front cover in an area where the top guide and the rear guide are connected to, thereby forming a cold air supply port through which the cold air is supplied from the heat exchanger into the storeroom.

2. The refrigerator of claim 1, further comprising:
a cold air guide to guide the cold air supplied from the heat exchanger into the storeroom to change a direction of the cold air supplied through the cold air supply port into the storeroom.

3. The refrigerator of claim 2, further comprising:
a door to open or close the storeroom;
a shelf disposed in the storeroom; and
a plurality of door guards disposed on a rear surface of the door and being spaced apart from one another in a vertical direction,
wherein a first door guard among the plurality of door guards includes:
a first hole is provided on a bottom surface of the first door guard to circulate cold air guided from the cold air guide into the storeroom to a second door guard among the plurality of door guards, and
a second hole is provided on a rear surface of the first door guard to circulate cold air guided from the cold air guide into the storeroom to the shelf.

4. The refrigerator of claim 2, further comprising:
a door to open or close the storeroom; and
a door guard disposed on a rear surface of the door,
wherein
the door guard includes a cold air direction guide having a curved portion, and
cold air guided from the cold air guide into the storeroom is directed by the curved portion of the door guard toward a rear side of the storeroom.

5. The refrigerator of claim 2, wherein the recessed portion is recessed from the top end of the front cover thereby forming the cold air supply port, and the cold air supply port is disposed adjacent to a top wall of the storeroom.

6. The refrigerator of claim 5, wherein the cold air guide is disposed on the top wall of the storeroom.

7. The refrigerator of claim 6, wherein the top guide is disposed on the top wall of the storeroom, and having a top fluid path formed therein to guide the cold air supplied from the heat exchanger to the cold air guide.

8. The refrigerator of claim 7, wherein the rear guide includes:

a middle cover disposed behind the front cover, the middle cover including:

a middle guide wall connected to the top guide; and a middle cold air supply port corresponding to the cold air supply port so that the cold air supplied from the heat exchanger is guided to the storeroom through the middle cold air supply port and the cold air supply port;

a rear cover disposed behind the middle cover and coupled to the middle guide wall to form a rear fluid path which connects to the top fluid path of the top guide to guide the cold air supplied from the heat exchanger to the top guide and the cold air supply port; and a fan disposed below the middle cover to circulate the cold air supplied from the heat exchanger into the rear fluid path.

9. The refrigerator of claim 8, wherein the middle cover includes a communication hole formed above the middle cold air supply port to supply the cold air supplied from the heat exchanger to the top guide and the cold air guide, and the top guide further includes a damper disposed adjacent to the communication hole to regulate a rate of flow of the cold air flowing to the cold air guide.

10. The refrigerator of claim 5, further comprising:

a door to open or close the storeroom; and a discharge port disposed on the top wall of the storeroom to discharge the cold air supplied from the heat exchanger into the storeroom, wherein the cold air guide further includes a blade to open or close the discharge port, and the blade is configured to control a degree of opening or closing of the discharge port based on whether the door is open or closed.

11. The refrigerator of claim 1, wherein the front cover is configured to supply the cold air supplied from the heat exchanger into the storeroom only through the cold air supply port.

12. The refrigerator of claim 1, wherein the cold air supply port is formed by a first recessed portion of a first side end of the front cover and a second recessed portion of a second side end of the front cover.

13. The refrigerator of claim 1, further comprising:

a shelf disposed in the storeroom and including:

a shelf fluid path to guide cold air supplied from the heat exchanger, and a cold air supply hole formed in at least one of an upper portion of the shelf or a lower portion of the shelf, to supply cold air supplied from the heat exchanger into the storeroom.

14. The refrigerator of claim 1, wherein the front cover includes:

a first cover part, and a second cover part which is detachable from and attachable to a bottom of the first cover part, and the first cover part includes a first recessed portion on an outer circumference of the first cover part that forms a first cold air supply port.

15. The refrigerator of claim 14, wherein the second cover part includes a second recessed portion on an outer circumference of the second cover part that forms a second cold air supply port.

16. The refrigerator of claim 15, further comprising:

a shelf disposed in the storeroom, wherein the first recessed portion is upwardly recessed from a bottom end of the first cover part to form the first cold air supply port, the second recessed portion is downwardly recessed from a top end of the second cover part to form the second cold air supply port, and the shelf is disposed in front of the first cold air supply port and the second cold air supply port.

17. A refrigerator, comprising:

an outer case;

an inner case the outer case;

a storeroom formed in the inner case;

a heat exchanger to produce cold air to be supplied into the storeroom; and a cold air guide assembly to guide the cold air from the heat exchanger to storeroom, the cold air guide assembly including:

a top guide disposed on top of the storeroom; and a rear guide disposed behind the storeroom, and connected to the top guide at top of the rear guide to guide the cold air to the top guide, the rear guide including a front cover defining one side of the storeroom, the front cover including a cut-out portion cut inwardly from a top end of the front cover in an area where the top guide and the rear guide are connected to, thereby forming a cold air supply port through which the cold air is supplied from the heat exchanger into the storeroom.

18. The refrigerator of claim 17, wherein the cut-out portion is cut inwardly from the top end of the front cover thereby forming the cold air supply port.

19. A refrigerator, comprising:

an outer case an inner case inside the outer case;

a storeroom formed in the inner case;

a heat exchanger disposed behind the storeroom to produce cold air; and a cold air guide assembly to guide the cold air from the heat exchanger to storeroom, the cold air guide assembly including:

a top guide disposed on top of the storeroom; and a rear guide disposed behind the storeroom, and connected to the top guide at top of the rear guide to guide the cold air to the top guide, the rear guide including a front cover formed of a glass material, wherein the front cover is disposed at a rear side of the storeroom and has a recessed portion recessed from a top end of the front cover in an area where the top guide and the rear guide are connected to, thereby forming a cold air supply port through which the cold air is supplied from the heat exchanger into the storeroom.

20. The refrigerator of claim 19, further comprising:

a cold air guide disposed on a top wall of the storeroom to guide the cold air produced by the heat exchanger into the storeroom to circulate the cold air supplied through the cold air supply port into the storeroom.

* * * * *